US005577802A

United States Patent [19]

Cowan et al.

[11] Patent Number: 5,577,802

[45] Date of Patent: Nov. 26, 1996

[54] ADJUSTABLE CHAIR

[75] Inventors: Benjamin Cowan; Marek Kmicikiewicz, both of Montreal, Canada

[73] Assignee: CKE Technologies, Inc., St. Laurent, Canada

[21] Appl. No.: 406,315

[22] Filed: Mar. 20, 1995

Related U.S. Application Data

[63] Continuation-in-part of Ser. No. 189,549, Feb. 1, 1994, abandoned, which is a continuation-in-part of Ser. No. 20,540, Feb. 22, 1993, abandoned.

[51] Int. Cl.[6] ..... A47C 1/024

[52] U.S. Cl. ..... 297/301.2; 297/302.2; 297/302.4; 297/303.2; 297/329

[58] Field of Search ..... 297/301.1, 301.2, 297/301.4, 301.5, 301.7, 303.1, 303.2, 303.4, 303.5, 322, 329, 342, 344.12, 344.14, 302.2, 302.4

[56] References Cited

U.S. PATENT DOCUMENTS

| | | | |
|---|---|---|---|
| 117,915 | 8/1871 | Morrison | 297/301.1 |
| 137,091 | 3/1873 | Parker . | |
| 160,624 | 3/1875 | Spencer . | |
| 465,719 | 12/1891 | Mitchell . | |
| 673,578 | 5/1901 | Johnson . | |
| 975,019 | 11/1910 | Cogger | 297/344.14 |
| 2,217,756 | 10/1940 | Lichter . | |
| 2,313,023 | 3/1943 | Ruegger . | |
| 2,492,106 | 12/1949 | Orton . | |
| 2,492,110 | 11/1949 | Prosser et al. . | |
| 2,611,420 | 9/1952 | Diehl . | |
| 3,999,799 | 12/1976 | Daswick . | |
| 4,383,714 | 5/1983 | Ishida . | |
| 4,547,017 | 12/1983 | Lescure . | |
| 4,650,249 | 3/1987 | Serber . | |
| 4,709,960 | 12/1987 | Launes | 297/329 X |
| 4,715,654 | 12/1987 | Laskowitz . | |
| 4,738,487 | 4/1988 | Shalinsky et al. . | |
| 4,981,326 | 1/1991 | Heidman | 297/304 |
| 5,024,484 | 6/1991 | Buchacz . | |
| 5,026,117 | 6/1991 | Faiks et al. | 297/304 |
| 5,042,876 | 8/1991 | Faiks | 297/304 |
| 5,048,893 | 9/1991 | Cowan et al. . | |
| 5,052,753 | 10/1991 | Buchacz | 297/303.1 |
| 5,121,934 | 6/1992 | Decker et al. | 297/304 X |

FOREIGN PATENT DOCUMENTS

| | | |
|---|---|---|
| 268746 | 6/1988 | European Pat. Off. . |
| 2463597 | 2/1981 | France . |
| 538539 | 10/1931 | Germany . |
| 701049 | 12/1940 | Germany . |
| 845606 | 6/1952 | Germany . |
| 1779141 | 9/1971 | Germany . |
| 2735583 | 2/1979 | Germany . |
| 8630390 | 4/1987 | Germany . |
| 9006925 | 12/1990 | Germany . |
| 100661 | 1/1941 | Sweden . |
| 931519 | 6/1982 | U.S.S.R. . |
| 17470 | 7/1913 | United Kingdom . |
| 2061100 | 5/1981 | United Kingdom . |
| WO8706810 | 11/1987 | WIPO . |

OTHER PUBLICATIONS

Society of Automotive Engineers (SAE) Handbook, 1986, pp. 34.32–34.35; 34.55; 34.57.

*Primary Examiner*—Peter R. Brown

*Attorney, Agent, or Firm*—Jacobson, Price, Holman & Stern, PLLC

[57] ABSTRACT

A chair comprises a base with a fixed stem extending vertically from the base and a track member mounted to the top of the stem. The track member is a segment of a circle, the center of which is forward of the chair and coincident with either the knee or ankle of the person utilizing the chair. A carriage having wings which are concentric with the track slides in the track. A seat is mounted on the carriage. The disclosure also relates to a backrest for a chair which pivots around an axis coincident with the H point axis relative to the chair, and to a chair which can shift in response to a person sitting on the chair, the chair also comprising a backrest which pivots around the H point.

37 Claims, 15 Drawing Sheets

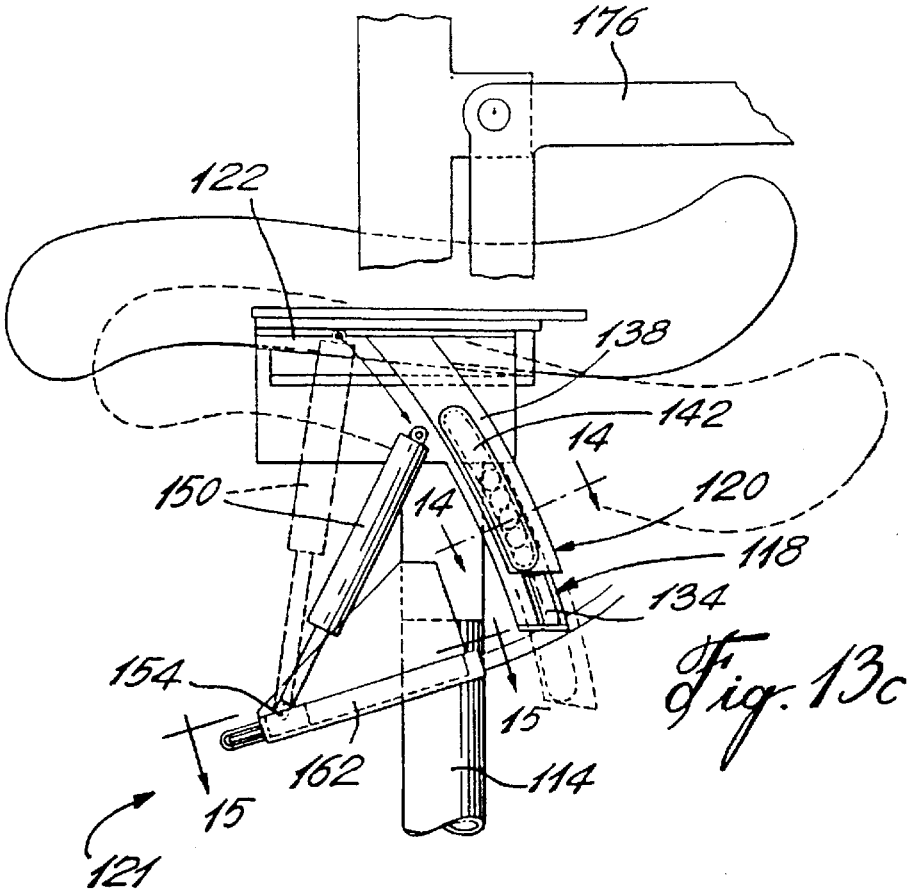
Fig. 13c
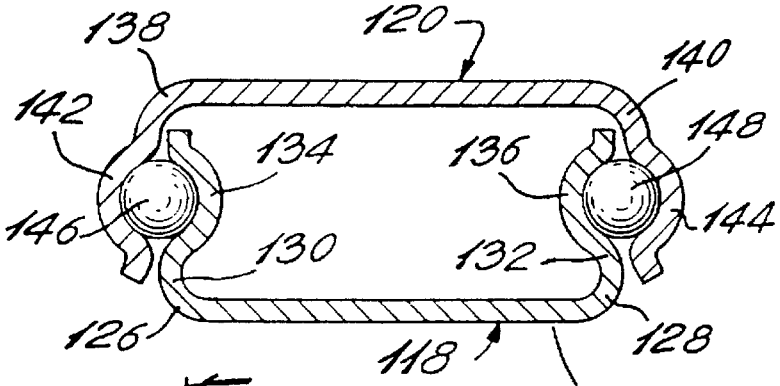
Fig. 14
Fig. 15
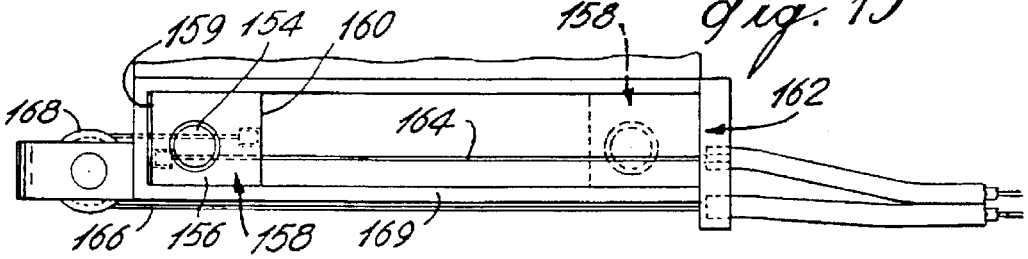

ADJUSTABLE CHAIR

CROSS-REFERENCE TO APPLICATION RELATED APPLICATION

The present application is a continuation-in-art of U.S. patent application Ser. No. 08/189,549 filed Feb. 1, 1994, abandoned, which is a continuation-in-part of U.S. patent application Ser. No. 08/020,540, filed Feb. 22, 1993, abandoned.

BACKGROUND OF THE INVENTION

1. Field of the Invention

The present invention relates to a sitting unit, such as a chair, and more particularly to a work station chair which can shift in response to a person leaning forward in the chair when in a working mode and leaning back in a rest position.

The present invention further relates to a backrest for a chair which pivots around an axis coincident with the H point axis relative to the chair. In addition, the present invention also relates to a chair which can shift in response to a person sitting on the chair, the chair also comprising a backrest which pivots about an axis coincident with the H point axis relative to the chair.

2. Description of the Prior Art

There have been many attempts in recent years to provide a work station chair which is ergonomic and which will adapt to the different positions assumed by a person working at a desk, table or computer.

A conventional rocking chair has certain advantages in this regard since it allows the person sitting on the chair to lean back in a rest position, wherein the person body can be relaxed and the back can be completely supported by the back rest. In a working position, the person normally leans forward over the desk or table, back erect. In a conventional non-rocking chair, the person would tend to sit on the front edge of the chair, while a rocking chair tilts forward with the shift in the center of gravity to continue to support the person's buttocks. However, a rocking chair is not practical. The center of gravity of the body must be relatively low in a rocking chair, thus preventing its use as a high chair as in the case of a drafting chair. Furthermore, it cannot be adapted with wheels. Most working station chairs must be equipped with wheels in order to allow the chairs to be easily displaced.

An improvement in terms of a working station chair but which must still be classified as a rocking chair is the chair described in U.S. Pat. No. 4,738,487, issued Apr. 19, 1988 to Shalinsky et al. In the Shalinsky et al patent, the chair is pivoted at the base such that the seat "rocks" forwardly and rearwardly to follow the person's center of gravity. The Shalinsky et al chair is also limited as to height since the arc of travel of the seat is determined by the radius from the pivot point on the base.

Another category of chairs for work stations which aims to allow passive forward and rearward movement of the seat in order to follow the attitude of the person leaning forward in a working mode or leaning back in a rest mode, includes the Setbar U.S. Pat. Nos. 4,650,249, issued Mar. 17, 1987, and the Cowan et al. U.S. Pat. No. 5,048,893, issued Sep. 17, 1991. In these patents, an arcuate track is provided at the top of the post and a carriage travels in the track with a seat mounted on the carriage. The arrangement allows the seat to passively adjust itself with the person's body in relation to changes in the center of gravity of the body.

However, it has been found that although the above chairs provide reasonable adjustment in the fore and aft directions and allow for tilting of the seat, they provide a compromise in terms of vertical adjustment. In fact, when a person leans forward to work, there is a vertical upward component to the movement. This movement is a somewhat rotational movement pivoting about the knees or ankles of the person. Likewise, when the person leans back in & rest position, there is a natural downward vertical component to the movement which is a rotation in the opposite direction pivoting about the ankles or knees.

Conventional backrests rotate around an axis located below the seat or at the back thereof. Upon tilting of such a backrest, the movement of the dorsal support member of the backrest is greater than that of the upper part of the body of the user in contact with the dorsal support member. The greater relative movement of this dorsal support member, as compared to that of the upper body of the user, is a disadvantage, since a discomfort is produced from that friction. For example, the relative movement Of the dorsal support member tends to pull out the shirt tail tucked inside the pants of the user leaning against the backrest.

It has been previously realized that when the backrest pivots about an axis which is essentially coincident with an axis passing through the hips (H point) of a person properly positioned on the chair, the movement of the backrest then coincides with the movement of the body, such that no such relative movement occurs between the dorsal support member and the upper part of the body of the user. Therefore, no friction occurs and no discomfort is felt. U.S. Pat. Nos. 5,024,484 and 5,052,753, both by Jurek Buchacz, describe a backrest which pivots about a point above the seat and in front of the backrest and including the H point. However, the mutual adjustment means permitting the sliding of the backrest in the seat in U.S. Pat. No. 5,052,753, as well as the frame members and runners described in U.S. Pat. No. 5,024,484, offer too much friction to permit a smooth operation of the backrest. Furthermore, the backrests taught in these two U.S. Patents are mounted on conventional seats or on seats which also pivot about the H point axis.

The H point, actually an H axis, is defined as the pivot center of the torso and thigh (Society of Automotive Engineers (SAE) Handbook, 1986, p. 34–55). As seen in FIG. 1 of the SAE Handbook (p. 34–33), the H point is defined as the point of intersection of the torso line and the hip axis. It is important to note that, while anatomical characteristics such as lower leg segment or thigh segment can vary significantly according to the user, the H point remains relatively constant. Thus, by taking into account parameters such as the cushion compression of the seat upon proper sitting of the user, and the buttocks segment of the majority of users (for example, the 95th percentile), the definition and location of the H point of the majority of users can be accurately predicted. From this H point, an H point relative to the chair can be positively located on the chair.

SUMMARY OF THE INVENTION

It is an aim of the present invention to provide a chair which provides a passive adjustment in the vertical plane in response to a shift in gravity of the person sitting on the chair.

It is a further aim of the present invention to provide a chair structure which can be combined with a horizontal adjustment mechanism such as described in the Cowan et al. U.S. Pat. No. 5,048,893.

It is still a further aim of the present invention to provide a chair with a backrest, such that the backrest provides a passive adjustment in the horizontal plane in response to a shift in gravity of the person sitting on the chair.

It is yet a further aim of the present invention to provide a chair with a backrest such that the chair structure can accommodate a horizontal adjustment mechanism such as described in the Cowan et al. U.S. Pat. No. 5,048,893.

It is an additional aim of the present invention to provide a chair with a backrest such that the passive adjustment in the horizontal plane of the backrest in response to a shift in gravity of the person sitting on the chair accompanies the passive adJustment in the vertical plane of the chair.

It is yet another additional aim of the present invention to provide a backrest for a chair which pivots around the H point relative to the chair.

A chair construction in accordance with the present invention comprises a base, at least a fixed stem extending vertically from the base, a track member mounted to the top of the stem, and a carriage slidable in the track. The track has a vertical component and a horizontal component such that the carriage moves on the H track within a vertical plane, and the movement of the carriage includes a vertical component greater than a horizontal component of the movement. A seat is mounted on the carriage. Spring means extend between the carriage and the track such that the seat is maintained in the uppermost position in equilibrium with a parson sitting erect on the chair in a work position, but the carriage will travel downwardly on the track in response to a rearward shift in weight by the person when moving from a work position to a rest position on the chair, and the seat mounted on the carriage will return to the uppermost position as the person leans forward to the work position.

In a more specific embodiment of the present invention, the track defines a circular arcuate segment with a radial center forward of the upright stem. More specifically, the radial center is coincident with the knees or with the ankles of a person sitting on the chair, and a positive adjustment means is provided for adjusting spring means such that the uppermost equilibrium position of the carriage can be maintained in response to different masses.

In yet an other specific embodiment of the present invention, there is provided a backrest for a chair whereby the backrest will tilt rearwardly and downwardly in response to a rearward shift in the weight of a person sitting on the chair, the tilt of the backrest following a rotational movement about an axis essentially coincident with the H point relative to the chair, the chair including support means, the backrest having mounting means, the mounting means comprising a crank lever, the crank lever comprising a first leg fixedly mounted to the backrest, a fulcrum on the support means coincident with the axis of rotation, the crank lever being mounted for rotation at the fulcrum, the crank lever including a second leg extending away from the fulcrum opposite the first leg, a backrest resilient means having a first end anchored at a fixed point on the support means and a second end anchored to a fixed point on the second leg, adjustment means provided for remotely adjusting the tension of said backrest resilient means, whereby the resistance against tilting of the backrest can be increased or decreased as a direct relation to the weight of the person sitting on the chair and leaning against the backrest; the adjustment means including cable means operably connected to a point on the resilient means between the first and second end of the resilient means to effectively increase the length of the resilient means and thereby increase the degree of tension of the resilient means or release said degree of tension.

In an additional specific embodiment of the present invention, a chair with a backrest is provided, such that the seat is mounted on a track that defines a circular arcuate segment with a radial center coincident with the ankles of a person sitting on the chair, and a positive adjustment means is provided for adjusting both the seat and backrest simultaneously according to the weight of the person sitting on the chair.

In yet another specific embodiment, there is provided a backrest for a chair, the chair having a seat and a support therefor, the backrest comprising mounting means adapted to be fixedly secured to the support, a track fixedly connected to the mounting means, the track defining a circular arcuate segment having a radial center essentially coincident with the H point relative to the chair, a follower element having a first and a second end, the first end being mounted to a dorsal support member, the second end being slidable on the track, low friction sliding means provided between the second end and the track, whereby the backrest will tilt rearwardly and downwardly in response to a rearward shift in the weight of a person leaning against the dorsal support member; the backrest further comprising resilient means extending between the follower element and the track such that the dorsal support member is maintained in an uppermost equilibrium position with a person sitting erect on the chair in a work position and whereby the follower element will slide downwardly along the rack in response to a rearward shift in the weight by the person when the person moves from a work position to a rest position on the chair against the resistance provided by the resilient means, and the dorsal support member and follower element will return to the uppermost equilibrium position as the person leans forward to the work position from the rest position.

The term chair as found in the specification and claims is intended to include seating devices in general.

Other features and advantages of the invention will be apparent from the description of the preferred embodiments given hereinafter. However, it should be understood that the detailed description while indicating preferred embodiments of the invention, are given by way of illustration only, since various changes and modifications within the spirit and scope of the invention will become apparent to those skilled in the art from this description of the preferred embodiments.

BRIEF DESCRIPTION OF THE DRAWINGS

Having thus generally described the nature of the invention, reference will now be made to the accompanying drawings, showing by way of illustration, a preferred embodiment thereof, and in which:

FIG. 13*a*, 13*b* and 13*c* are fragmentary side elevations of details shown in FIGS. 11 and 12, illustrating the adjustable support device in different operating positions.

FIG. 14 is a a fragmentary vertical cross-section taken along line 14—14 of FIG. 13;

FIG. 15 is a fragmentary horizontal view taken along line 15—15 of FIG. 13*c;*

DESCRIPTION OF THE PREFERRED EMBODIMENTS

Figure 1:
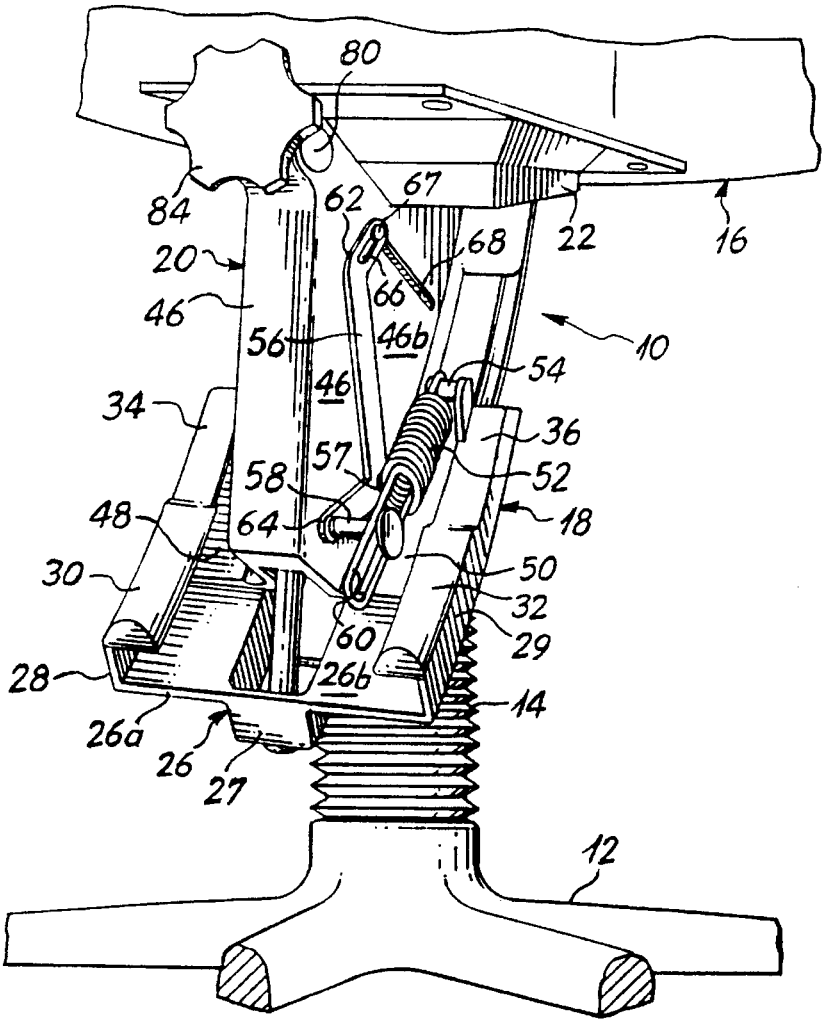
FIG. 1 is a fragmentary perspective view of a chair in accordance with the present invention.

Referring now to the drawings and in particular to FIG. 1, there is shown a chair 10 having a base 12 and an upstanding post 14. As shown in FIGS. 1, 5, 4, 5, and 6, the chair 10 also includes a seat 16 mounted to the post 14 by means of the adjustable support device which is subject of the present invention and which is represented by a track member 18 and a carriage 20. As seen in these drawings, the seat 16 includes a seat pan adapter 22 fixedly mounted to the carriage 20 which in turn slides in the track member 18. The track member 18 is mounted to the post by mounting sleeve 24.

Figure 6:
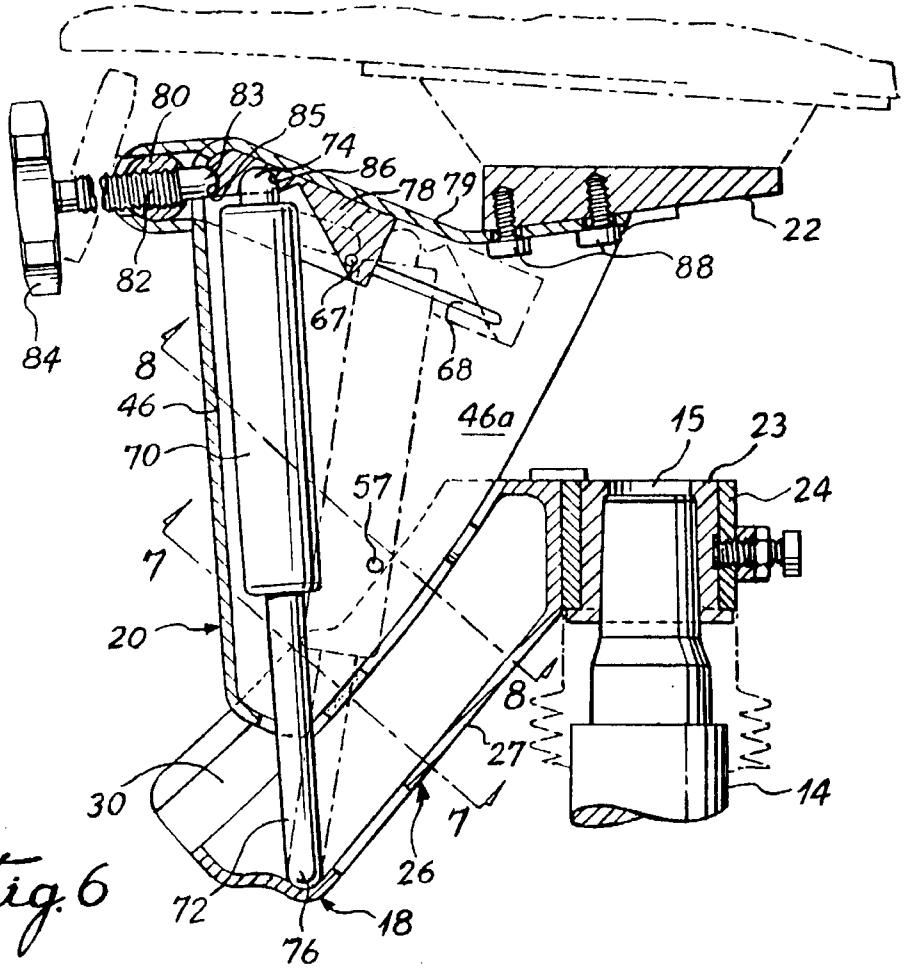
FIG. 6 is a fragmentary vertical cross-section taken along line 6—6 of FIG. 5.

As shown in FIG. 6, the top of the post 14 has a frusto-conical spindle 15 on which a bearing 23 is journaled. The mounting sleeve 24 is connected directly to the bearing 23. The track member 18 is welded or otherwise fixed to the mounting s leers 24 and extends at an angle of approximately 45° to the vertical axis of the post 14.

Figure 10:
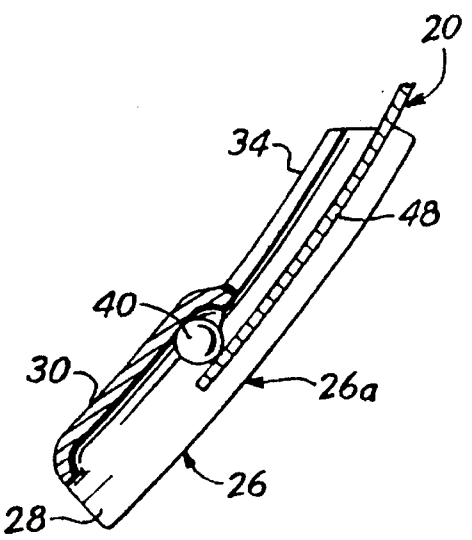
FIG. 10 is a fragmentary vertical cross-section taken along line 10—10 of FIG. 5.
Figure 9:
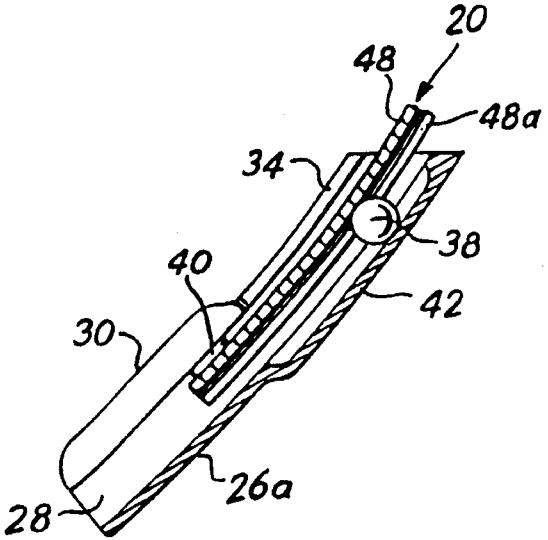
FIG. 9 is a fragmentary vertical cross-section taken along line 9—9 of FIG. 5.
Figure 8:
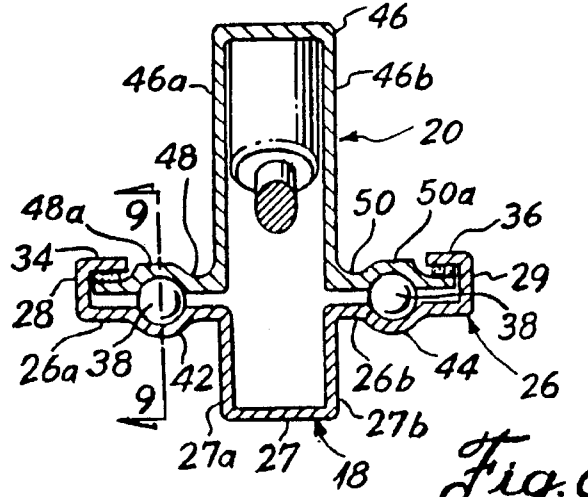
FIG. 8 is a cross-sectional view taken along line 8—8 of FIGS. 5 and 6.

The track member 18 includes a tray 26 with rail members 26*a* and 26*b* defining a segment of a circular arc in a vertical plane passing through the post 14. The arcuate configuration, of the rails 26*a* and 26*b*, is best illustrated in FIGS. 9 and 10. The tray 26 also includes a channel-shaped recessed portion 27 including side wails 27*a* and 27*b*. The rails 26*a* and 26*b* are provided with side walls 28 and 29. The tray 26 includes races 30 and 32 formed as flanges extending from the side walls 28 and 29 respectively. The upper portion of the tray 26 is provided with flanges 34 and 36 as shown in FIGS. 8 through 10. The rails 26*a* and 26*b* are also provided with races 42 and 44 as shown in FIGS. 8 and 9 for accommodating bearing balls 38.

Figure 7:
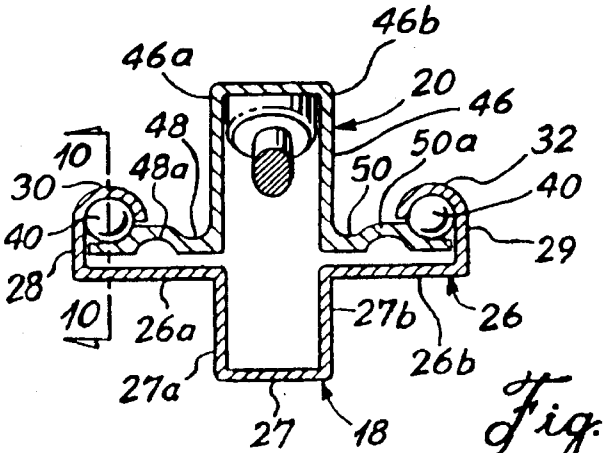
FIG. 7 is a cross-section taken along line 7—7 of FIGS. 5 and 6.

The carriage 20 includes a channel-shaped housing 46 provided with side walls 46*a* and 46*b* which in turn mount wings 48 and 50. Races 48*a* and 50*b* are formed respectively in wings 48 and 50. Ball bearings 40 are provided between the races 30 and 32 and wings 48 and 50 respectively, as shown in FIGS. 7 and 10. Ball bearings 38 are provided in races 42, 48*a*, and 44 and 50*a* respectively. The ball bearings 38 and 40 located between the tray 26 and the carriage 20 are arranged in order to balance the various force components, when the carriage 20 slides in the track member 18.

It is noted that the wings 48 and 50 are concentric segments of a circular arc to the rails 26*a* and 26*b*.

Thus, the seat 16 mounted to the carriage 20 can be tilted rearwardly and downwardly as a result of the sliding movement of the carriage 20 along the locus of an arc with the center thereof adjusted to be at the pivot point of the knees or ankles of the person sitting in the chair 10. The embodiment shown in the drawings is based on the pivot point K being at the knee.

Figure 5:
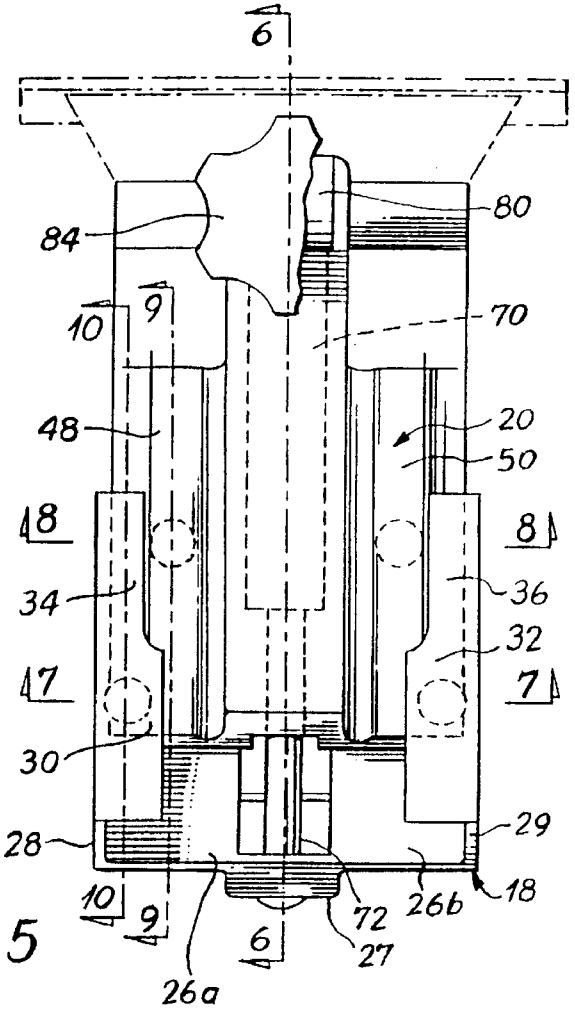
FIG. 5 is a fragmentary front elevation of the detail shown in FIGS. 1, 3, and 4.

As shown in FIGS. 5 and 6, an air cylinder 70 including a piston 72 is located in the housing 46 of the carriage 20, and the piston extends down into the channel-shaped recess 27 of the tray 26 which is part of the track member 18. The cylinder 70 has a spherical head end 74 which is adapted to engage a spherical socket 86 in a sliding bracket 78 in carriage 20. The piston 72 also has a spherical head end 76 which is adapted to engage a socket in the bottom of the tray recess 27.

As seen in FIG. 6, the sliding bracket 78 in carriage 20 can be adjusted within the housing 46 by means of a knob 84 mounting a bolt 82 which is threaded and passes through a cylindrical nut 80. The end of bolt 82 has a spherical shape at 83 and is mounted in a spherical socket 85. On turning of the knob 84, the bolt 82 will move the bracket 78 between the position shown in full lines in FIG. 6 and the position shown in dotted lines in this same FIG. These two positions represent the extremes of the adjustment of bracket 78 and, therefore, the cylinder 70 as well as the springs 52 (shown in full lines and in dotted lines in FIG. 3).

The bracket 78 is adapted to slide on ramp 79 forming part of the housing 46. The ramp 79 is at an angle of 23° to the horizontal. As the bracket 78 slides against the ramp 79 by adjustment of the knob 84 and bolt 82, the cylinder will move towards the dotted lane position in FIG. 6 and be compressed by the action of the bracket 78 moving in the sloped ramp 79.

Figure 4:
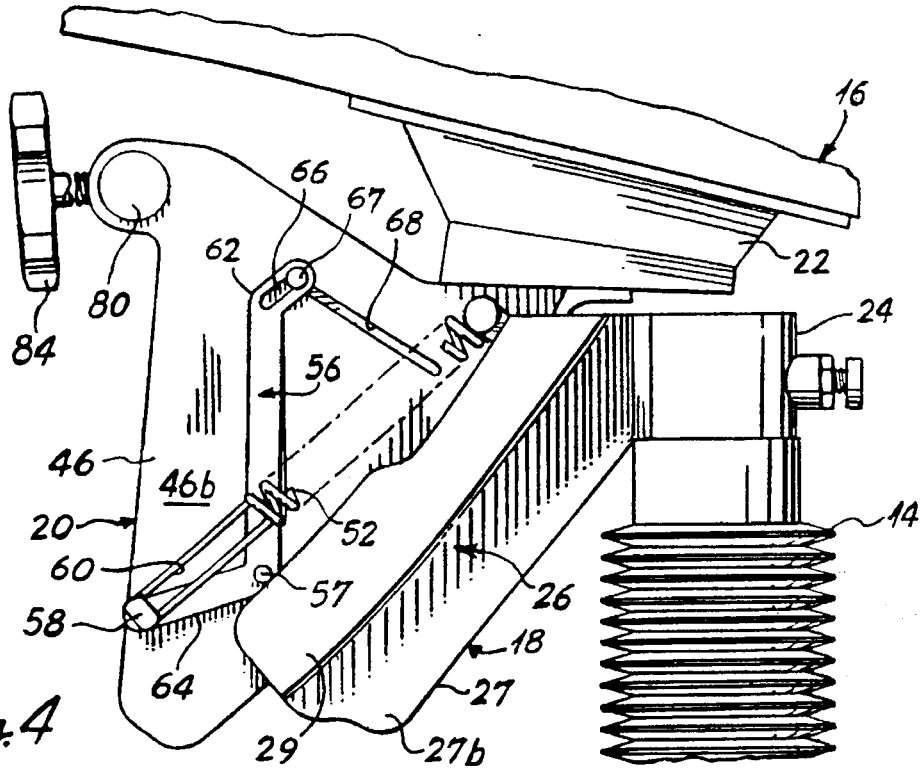
FIG. 4 is a fragmentary side elevation, similar FIG. 3, but showing the device in a different operative position.

The carriage 20 includes a spring 52 attached at one end to a mounting member 54 on the track member 18 and connected at the other end to the mounting remember 58. The spring 52 forms a lost motion slot 60 at the end on which it is connected to the mounting member 58. Mounting member 5 is, in fact, mounted to a lever 56, the fulcrum of which is at pivot shaft 57 on the side wall 46*b*, for instance. Lever 26 has a dog-leg shape including end 64 and end 62. The end 62, as shown in FIG. 4, has a lost motion slot 66 through which pin 67 projects.

Figure 2A:
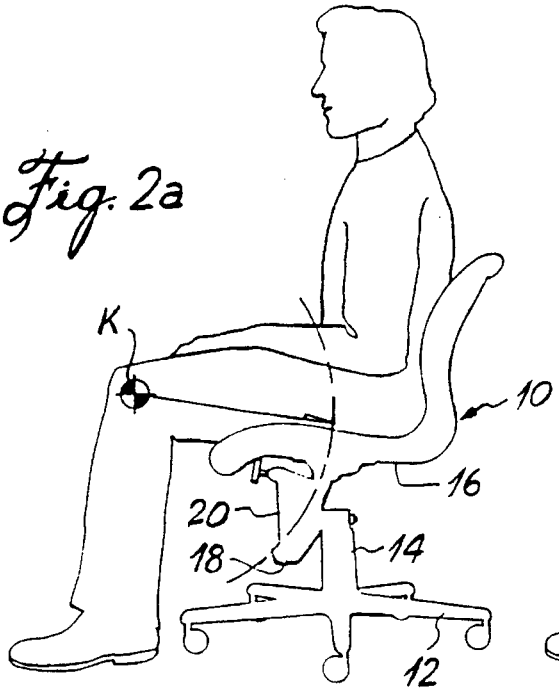
FIGS. 2*a* and 2*b* are schematic views showing the chair of FIG. 1 in different operative positions.
Figure 3:
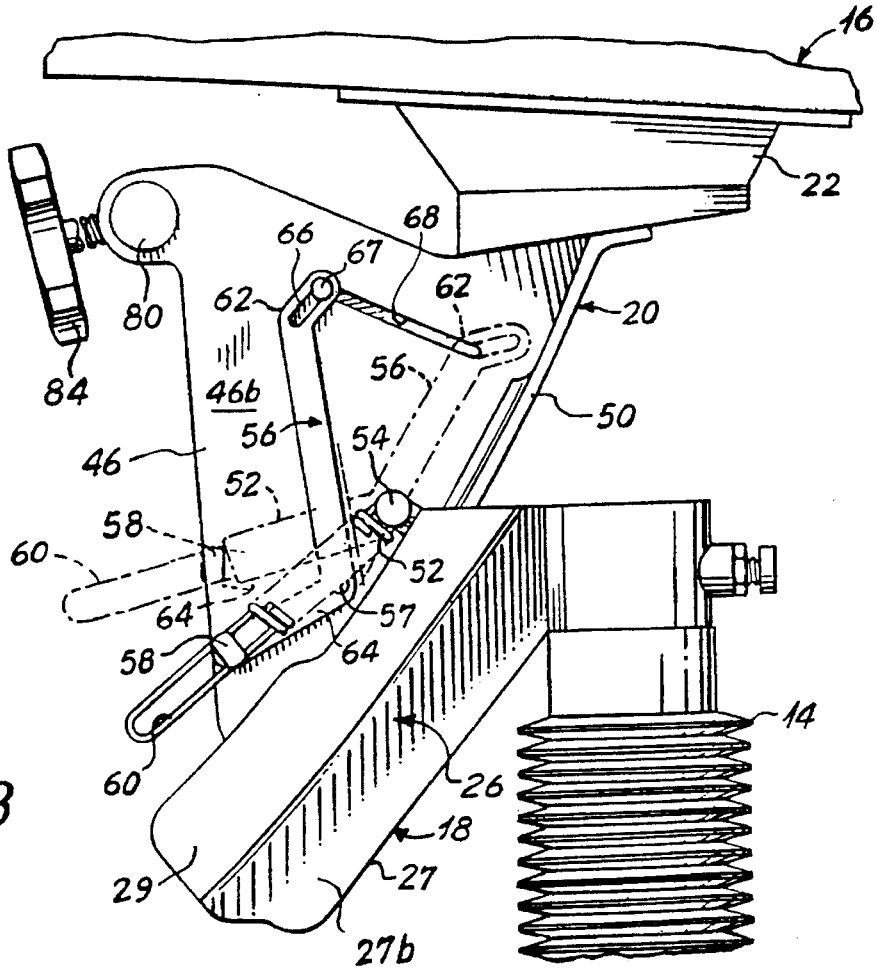
FIG. 3 is a fragmentary side elevation showing the detail of FIG. 1.

In operation, the person using the chair wall assume a working position as shown in FIG. 2*a*. In this position the person will be upright or leaning forward over a work table. In such a case, the center of gravity of the person will be over the post 14 or forward thereof. The air cylinder 70 should be sufficient to maintain the seat 16 in its uppermost position at the end of the cylinder extent, and thus, the carriage 20 will be in its uppermost position such as shown in FIGS. 1, 2*a*, and 3. The weight of the person using the chair will affect the equilibrium of the carriage 20 in the track 18. In this position, the chair functions as a normal work station chair. The chair could be adapted with a seat adjustment device as described in U.S. Pat. No. 5,048,893, Cowan et al.

Figure 2B:
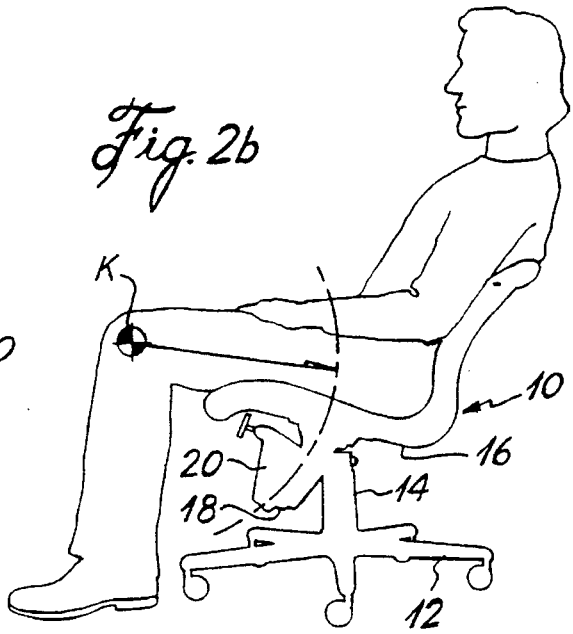

When the person leans back to a rest position, as shown in FIG. 2*b*, the center of gravity will shaft rearwardly relative to the post 14 to a point where the action moment will overcome the resistance of the air cylinder 70 and the seat on the carriage 20 will begin to move downwardly following the arcuate path traced by the wings 48 and 50 moving in the rails 26*a* and 26*b* of the track member 18. As noted, the sliding movement of the carriage 20 in the track 18 is in a circular arc with the center K at the knees of the person as shown in FIG. 2*b*. As the cylinder 70 is overcome and the carriage moves clockwise in the track 18, the center of gravity is further moved outwardly from the point K thereby increasing the action motion. At that time, the mounting pin 58 on the carriage 46 will reach the end of the lost motion slot 60 in the spring 52, and the spring 52 will exert supplemental resistance on the further movement of the carriage 20 in the track 26. Once the person leans forward away from a rest position to an erect or work position, as shown in FIG. 2*a*, the spring 52 will retract pulling the mounting member 58 and thus the .carriage 20 along with it, and the air cylinder 70 will also extend to move the carriage 20 to its original work position as shown in FIG. 2*a* and FIG. 3.

The position for lighter persons is shown in FIG. 6, but if a heavier person is to use the chair, the knob 84 is rotated so as to move the sliding bracket 78 outwardly toward the extreme position shown in dotted lines in FIG. 6 or an intermediate position therebetween. The cylinder 70 will thus be compressed relative to its position shown in full lines in FIG. 6 and be farther away from the center K of the person's knees, thereby increasing the resistance to downward movement of the carriage 28. At the same time, the dog-leg levers 56 move by means of pins 67 on the carriage 20 traveling in slot 68 and drawing the end 62 of lever 56 in clockwise rotation, thereby moving the end 64 and mounting member 58 which in this case changes the angle of the spring 52. As can be seen, therefore, the spring 52 and air cylinder 70 can be adjusted to provide equilibrium for heavier persons using the chair merely by adjustment of the knob 84. Thereafter, the operation is the same as previously described.

Referring now to the drawings, it will be noted that in FIGS. 11 to 20, the different parts are represented by numbers in the hundreds. Furthermore, some of the parts already depicted in FIGS. 1 to 10 were not depicted in FIGS. 11 to 20 to enhance clarity thereof.

Referring now to FIGS. 11 to 20, a preferred embodiment of a chair 110, having a base 112 is shown. It is to be noted that the chair described is symmetrical along the longitudinal axis passing through the upstanding post 114. For the sake of clarity, only the left side of the chair is depicted in FIGS. 11, 12, 13*a*, 13*b*, 13*c*, 14, 15, 16, 17 and 19 to ensure unambiguity in FIGS. 19 and 20, some components of the right side of the chair are depicted by the same number designating a component of the left side but followed by "a".

As shown in FIGS. 11, 12, 13*a*, 13*b* and 13*c*, the chair 110 also includes a seat 116 mounted to the post 114 by means of an adjustable support device which is represented by a track member 118, a carriage 120 and a tension adjustment means 121. As seen in these drawings, the seat 116 includes a seat pan adapter 122 fixedly mounted to the carriage 120 which in turn slides in the track member 118. The track member 118 is mounted to the post by mounting sleeve 124, which can be similar to the mounting sleeve 24 in FIGS. 4 and 6.

The track member 118 is welded or otherwise fixed to the mounting sleeve 124 and extends at an angle to the vertical axis of the post 114. The track member 118 defines a segment of a circular arc in a vertical plane passing through post 114. The arcuate configuration of 118 is convex and is best illustrated in FIGS. 11, 12 and 13*a*, 13*b* and 13*c*. The track member includes a tray 125. The tray includes rail members 126 and 128 and also includes side wall 130 and 132 defining races 134 and 136 as best illustrated in FIGS. 13*c* and 14. The carriage 120 is provided with side walls 138 and 140 which define races 142 and 144. Ball bearing 146 and 148 are provided between races 134 and 142 and 136 and 144, respectively.

The ball bearings 146 and 148 located between the tray 125 and the carriage 120 are arranged in order to balance the various force components when the carriage 120 slides in the track member 118.

It is noted that the races 134 and 136 are concentric segments of a circular arc to the races 142 and 144.

Thus, the seat 116 mounted to the carriage 120 can be tilted rearwardly and downwardly as a result of the sliding movement of the carriage 120 along the locus of an arc with the center thereof adjusted to be at the pivot point of the ankles of the person sitting on the chair 110.

Figure 11:
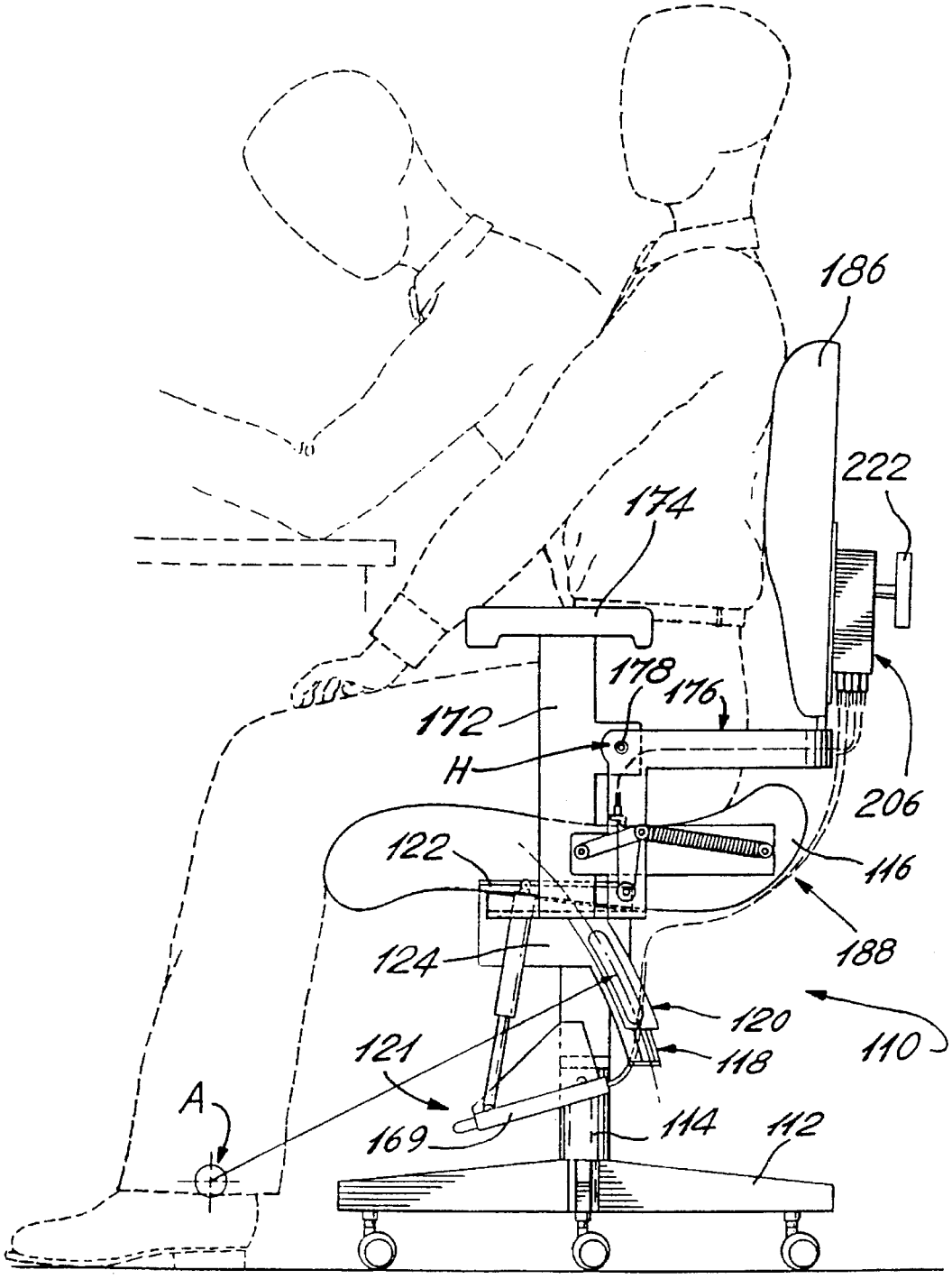
FIG. 11 is a side view of a chair with an adjustable backrest in accordance with the present invention.
Figure 12:
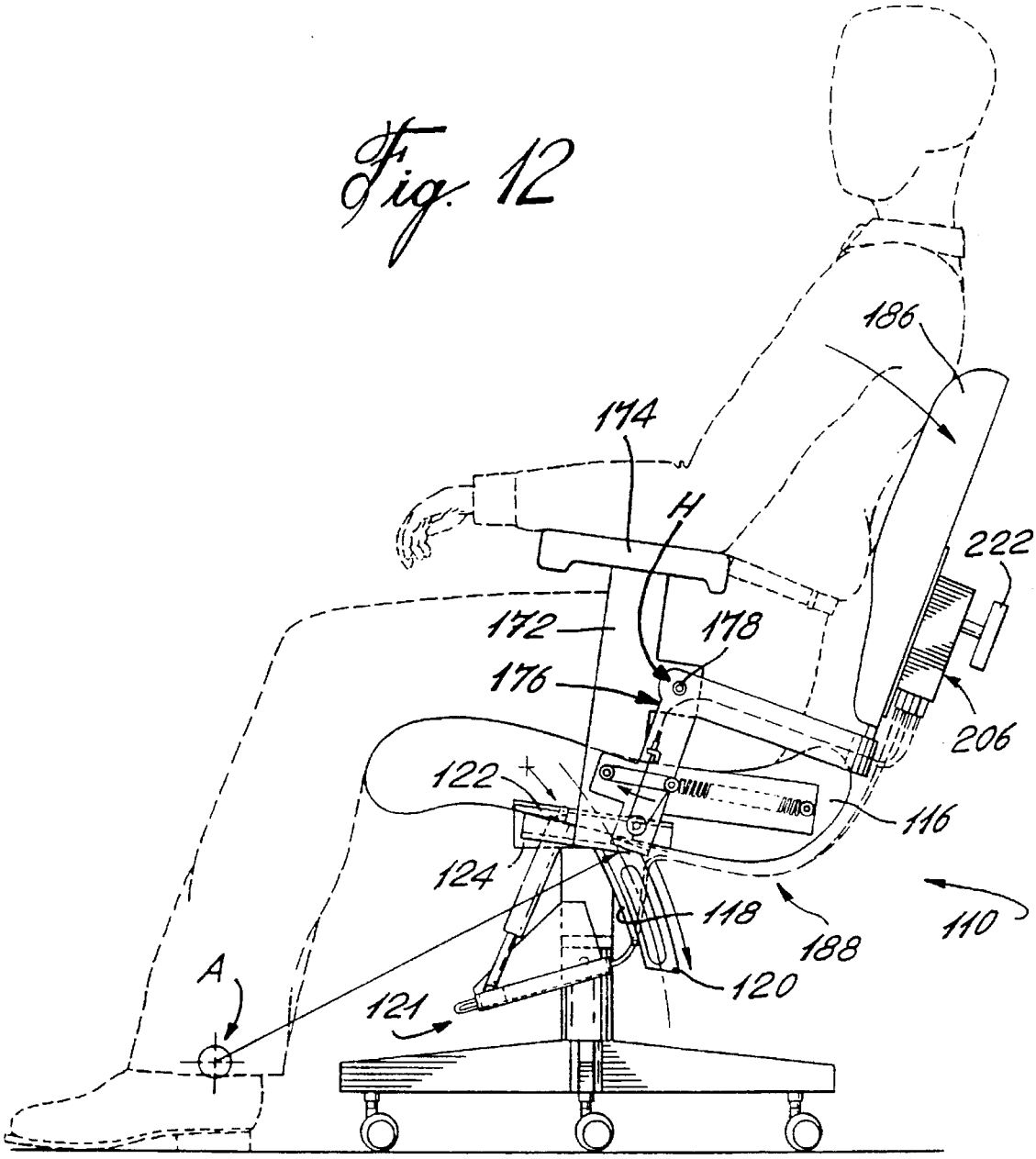
FIG. 12 is a side view of the chair of FIG. 11 in a different operative position.
Figure 13A:
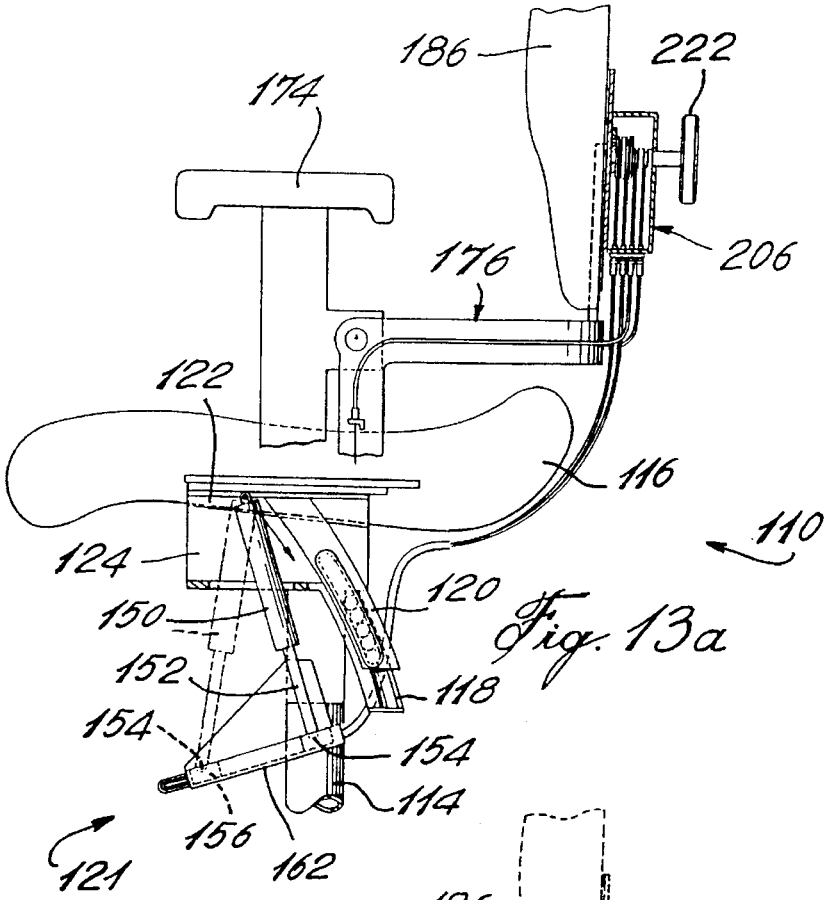
Figure 13B:
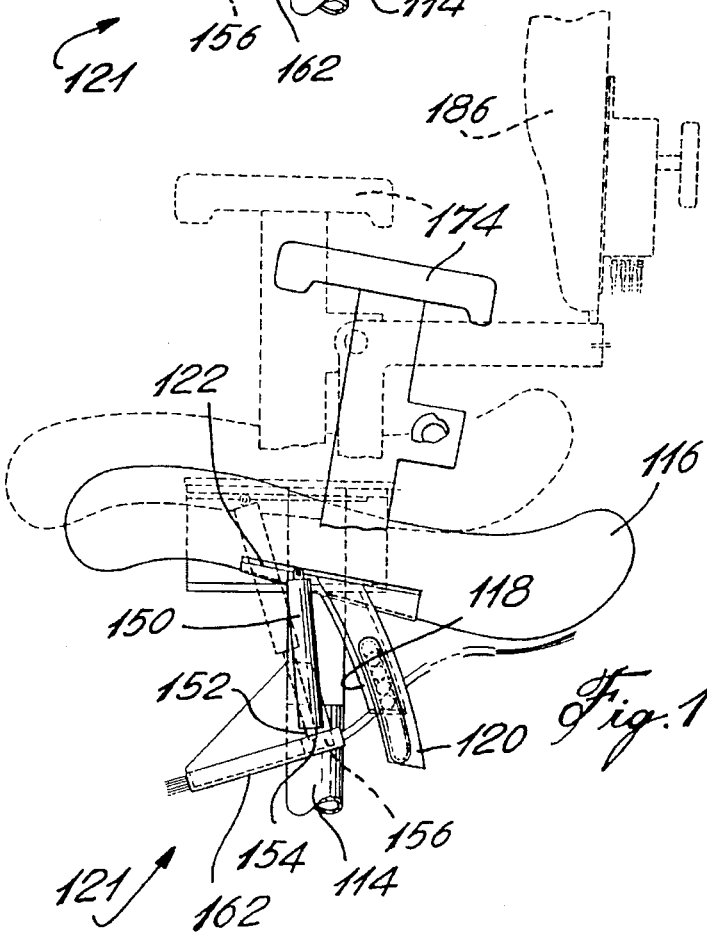

As shown in FIGS. 11, 12 and best exemplified in FIGS. 13*a*, 13*b* and 13*c*, an air cylinder 150 including a piston rod 152 is included. The cylinder 150 is mounted at the top to the seat pan 122. Similarly to the spherical head end 74 of the cylinder 70 in FIGS. 5 and 6, the piston rod 152 has a spherical head end 154 which is adapted to engage a spherical socket 156 in a sliding bracket 158 in a tension adjustable means 121 for the seat 116. The tension adjustment means is provided with a housing 162 and the adjustable sliding bracket is provided with side walls 159 and 160.

Figure 18:
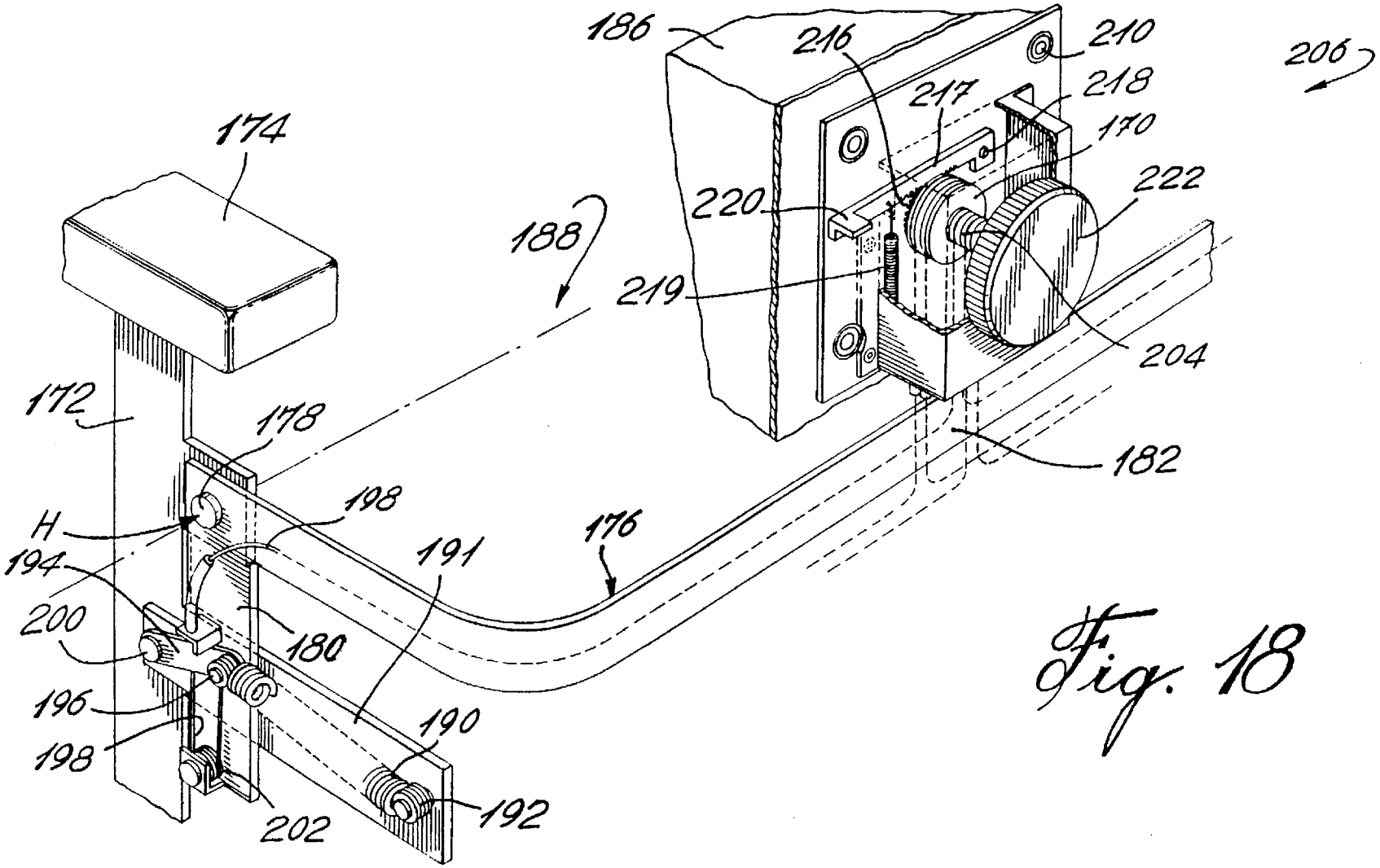
FIG. 18 is a fragmentary perspective view of the backrest and seat adjustment device.

As seen in FIGS. 15 and 18, the sliding bracket 158 can travel within the housing 162 by means of cables 164 and 166 passing about a pulley 168. The Cable 164 is fixed at one end to the side wall 159 of the sliding bracket 158 and at the other end to a spool 170. Similarly the cable 166 is fixed at one end to the other side wall 160 of the sliding bracket 158 and at the other end to the spool 170. The mechanism of adjustment through the spool 170 will be described below.

The sliding bracket 158 is adapted to slide on track 169, forming part of the housing as shown in FIGS. 13*a* and 13*b* and best exemplified in FIG. 15. By drawing the sliding bracket 158, the cable 164 will move the bracket 158 on the track 169 between the position shown in full lines in FIG. 15 and the position shown in dotted lines. These two positions represent the extremes of the travel of bracket 158 and therefore the spherical head end 154 of the piston rod 152.

The cable 166, moving in the opposite direction with respect to cable 164, will be drawn by the movement of the sliding bracket 158 described above. When the sliding bracket 158, is in the position depicted by the dotted line in FIG. 15, the function of the cables is reversed: cable 166 will draw the bracket 158 in the reverse direction, from the position depicted by dotted lines in FIG. 15 to the position shown in solid lines in this same Figure.

The track 169 is at an angle to the horizontal, as the bracket 158 slides on the track 169 by the pulling action of cable 164. The spherical head end 154 will move towards the dotted line position in FIG. 13*a* and be precompressed by the action of the bracket 158 moving in the sloped track 169.

Figure 16:
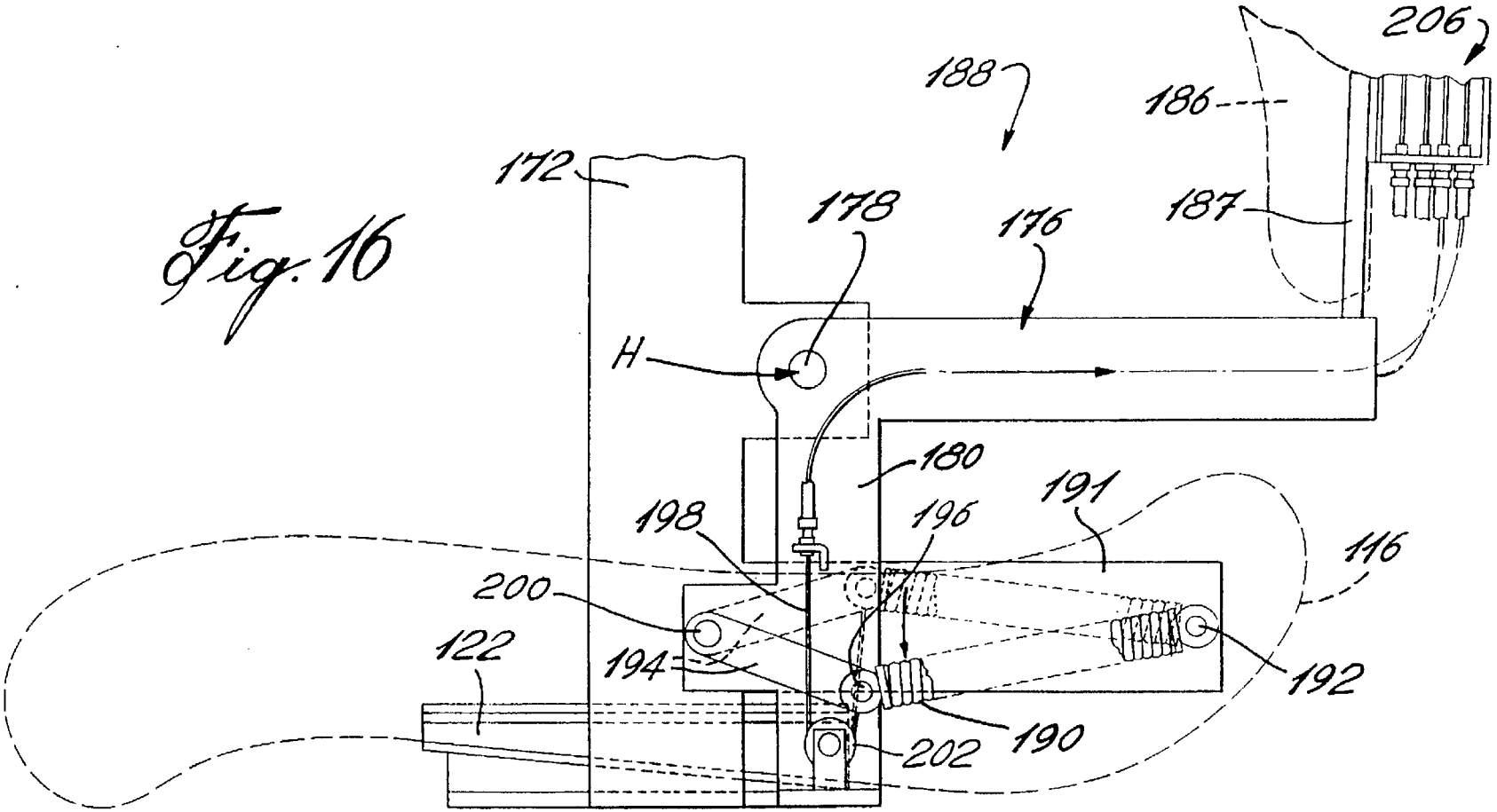
FIG. 16 is an enlarged fragmentary side elevation showing a detail of FIGS. 11 and 12.
Figure 17:
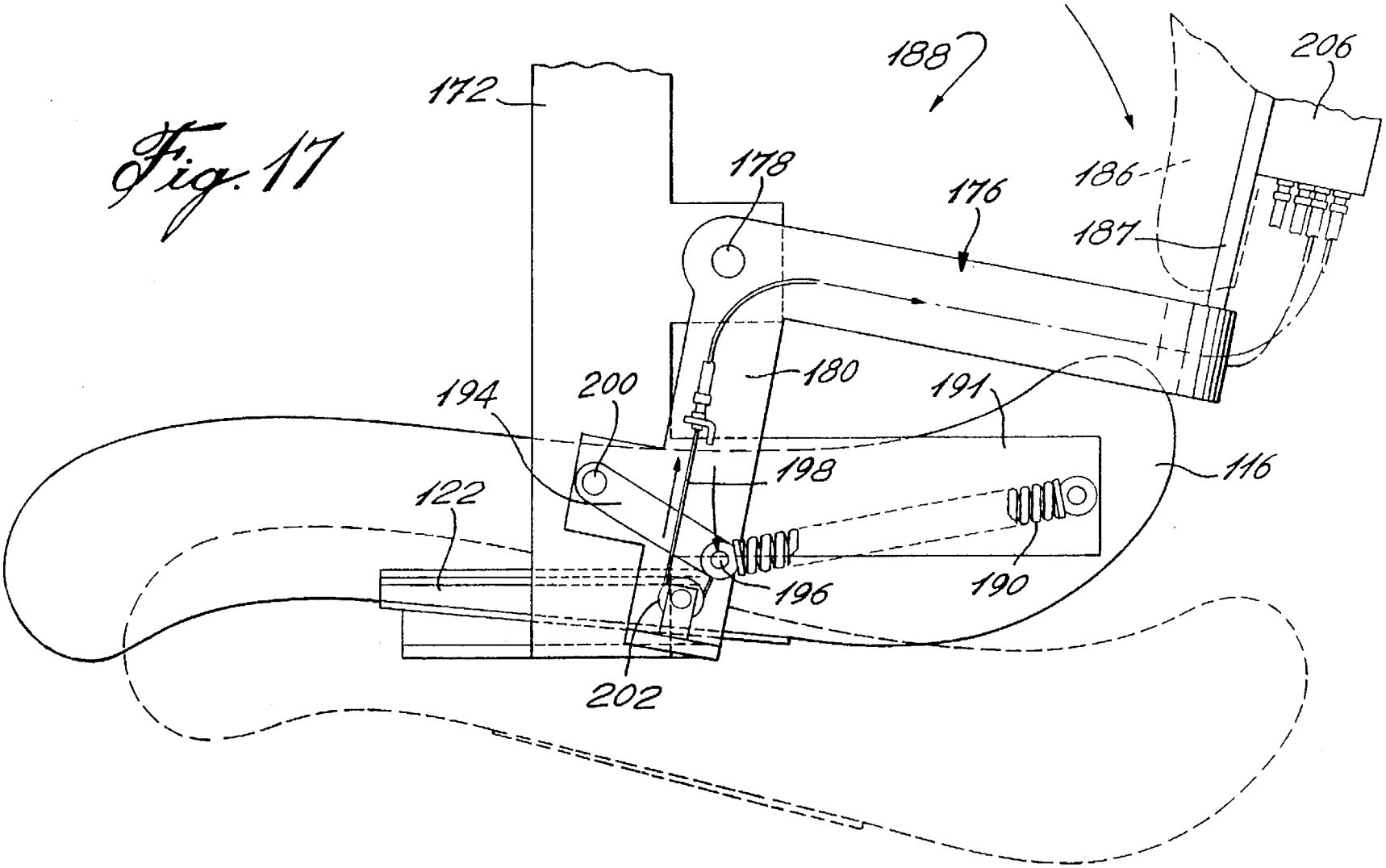
FIG. 17 is a fragmentary side elevation similar to FIG. 16, but showing the adjustable support device for the backrest in a different operative position.

Referring now to FIGS. 11 and 12 and more particularly to FIGS. 16 to 18, there is shown a second upstanding post 172, fixedly mounted at one end to the seat 116, through the seat pan 122, for example, and at the other end, to an arm rest 174. A dog leg lever 176 is mounted on the second upstanding post 172 through a fulcrum 178 about which the lever 176 pivots. The fulcrum 178 is located such that it is coaxial to the "H" axis passing through the hips of the person sitting on the chair and represented by a dotted line in FIG. 18. The H point is the point at which the high line intersects the torso line. The dog leg lever 176 comprises a crank leg 180 and a leg 182. The leg 182 of the lever 176 mounts a backrest 186 through a third upstanding post 187. The crank 180 is connected at its bottom end to a backrest tension adjustment means 188. The backrest tension adjustment means 188 includes a spring 190 pivotaly attached at one end to an extension arm 191 of post 172, by way of a fastener 192. The other end of the spring 190 is attached to one end of a linking member 194 through a bracket 196 which also acts as a pivot point. The bracket 196 is connected to a cable 198 such that the cable will permit a variation in the distance between the bracket 196 and the fulcrum 178. The other end of the linking member 194 is pivoted to the crank leg 180 by way of a fastener 200 that acts as a fulcrum about which the other end of the linking member pivots.

As seen in FIG. 18, the backrest tension adjustment means 188 can be adjusted by means of the cable 198 passing about a pulley 202, fixedly mounted on the crank leg 180. The other end of cable 198 is fixedly mounted to a second spool 204 mounted on spool 170. The mechanism of adjustment through the spool 204 will be described below.

Through its action on the bracket 196, the cable 198 will move the end of the spring 190 and linking member 194 between the position shown in dotted lines in FIG. 16 to the position shown in full lines. These two positions represent the extreme of the backrest tension adjustment means.

Figure 19:
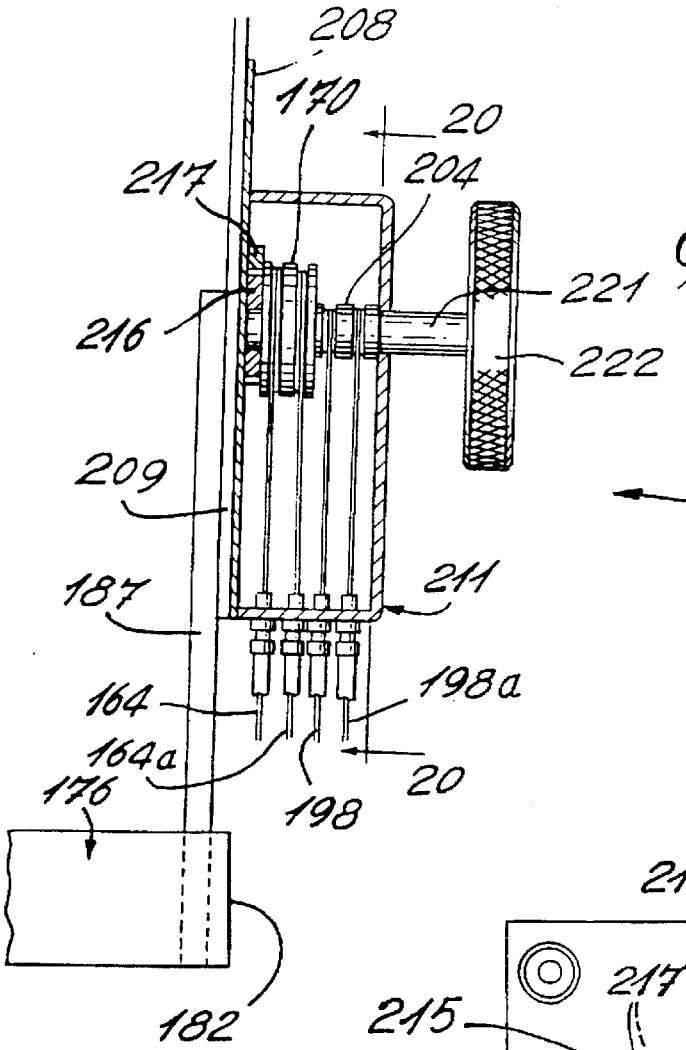
FIG. 19 is a fragmentary side elevation partly in cross-section of a detail of the chair in FIGS. 11 and 12.
Figure 20:
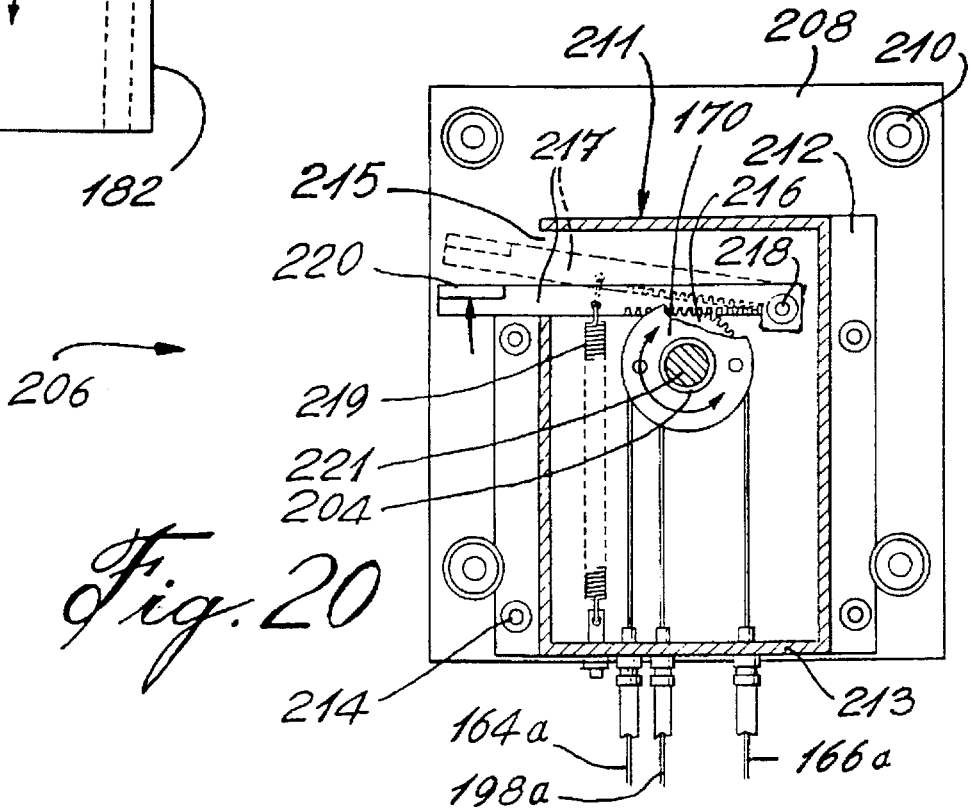
FIG. 20 is a fragmentary vertical cross-section taken alone line 20–20 of FIG. 19.

A tension control device 286 is provided such that the seat tension adjustment means 121 and the backrest tension adjustment means 188 can be adjusted simultaneously, see FIGS. 18–20. A mounting member 209 is welded or otherwise fixed to the upstanding post 187. The tension control device 206 comprises a back plate 208, fixedly mounted on the mounting member 209 by fasteners R10. A housing 211 provided with a rim 212 and a base 213 is mounted on the back plate 208 by fasteners 214. The housing 211 is provided with an opening 215. The tension control device 206 comprises a sprocket 216 mounted on the shaft 221. The sprocket engages a lever 217 provided with teeth. The lever 217 is mounted to the back plate 208 through fulcrum 218, about which the lever pivots. The tension control device 206 is also provided with a spring 219 attached at one end to the lever 217 and at the other end to the base 213 of the housing 211. The spring 219 thus maintains the sprocket 216 locked by the lever 217. The lever 217 is also provided with a flange 220. The other end of the lever 217, opposite the fulcrum 218, protrudes from the opening 215 and housing 211 and can be lifted by the flange 220, to free the movement of the sprocket 216.

The first spool 170 is mounted on a shaft 221 journaled on the backplate 208 and housing 211 and the spool 170 is coaxial to the sprocket 216. A second spool 204 is also mounted on the shaft 221 and on a knob 222 which is fixed to the end of the shaft 221, Such that the movement of the sprocket 216, the spools 170 and 204 are dependent from that of the knob 222. The movement of the knob 222 clockwise for example, results in the same movement of spools 170 and 204 and translates for the left side of the chair, in a drawing action on cables 164 and 198 which results in the movement of the air cylinder 150 from the position shown in dotted lines in FIG. 13*a* and the position shown in solid lines and the movement of the spring 190 and linking member 194 from the position shown in dotted lines in FIG. 16 and the position shown in full lines, respectively. While a clockwise movement of the knob 222 winds cables 164 and 198 on spools 170 and 204 respectively. This same movement of the knob 222 unwinds cable 166. Since cable 166 is fixed to the other side wall 160 of the sliding bracket 158, the sliding of bracket 158 through the pulling action of cable 164 will draw cable 166. Additionally, the clockwise movement Of the knob 222 draws cables 164*a* and 198*a* but unwinds cables 166*a*, see FIGS. 19 and 20. The movement of the knob 222 counterclockwise results in the reverse actions for cables 164, 164*a*, 198, 198*a* and 166, 166*a*, respectively.

In operation, the person using the chair will assume a working position as shown in FIG. 11. In this position, the person is upright or leaning forward over a work table. In such a case, the center of gravity of the person will be over the post 114 or forward thereof. The air cylinder 150 should be sufficient to maintain the seat 116 in its uppermost position at the end of the cylinder extent, and thus, the carriage 120 will be in its uppermost position such as shown in FIGS. 11, 13*a* and 13*c*. The seat tension adjustment means 121 and the backrest tension adjustment means 198 as shown in FIG. 11 are adjusted for lighter persons. The spring 190 of the backrest tension adjustment means through its retracting action maintains the backrest erect. The weight of the person using the chair will affect the equilibrium of the carriage 120 in the track 118. In the position shown in FIGS. 11, 13*a* and 13*c*, the chair functions as a normal work station chair. The chair could be adapted with a seat adjustment device as described in U.S. Pat. No. 5,048,893, Cowan et al.

When the person leans back to a rest position, as shown in FIGS. 12 and 13*b*, the center of gravity will shift rearwardly relative to the post 114 to a point where the action moment will overcome the resistance of the air cylinder 150 and the seat on the carriage 120 will began to move downwardly following the arcuate path traced by the clockwise movement of the carriage 120 in the rails 126 and 128 of the track member 118. As noted, the sliding movement of the carriage 120 in the track 118 is in a circular arc with the center A (for ankle) at the ankles of the person as shown in FIGS. 11 and 12. Concomitantly, at the person leans back, the weight exerted on the backrest translates in a pulling action from crank leg 180 on the spring 190. When the force applied on the spring 190 by the pulling action of the leg 180 overcomes the intrinsic force of the spring 190, the spring is further extended and allows the rearward and downward tilt of the backrest as exemplified in FIGS. 12 and 17.

Once the person leans forward away from a rest position to an erect or work position, as shown in FIG. 11, the air cylinder 150 will extend to move the carriage 120 to its original work position as shown in FIG. 11. Concomitantly, the spring 190 will retract the leg 180 and thus permit a return of the backrest to the erect position as shown in FIG. 11.

The position for lighter persons is shown in FIGS. 11, 12, 13*c* and 18, but if a heavier person is to use the chair, the knob 222 is rotated clockwise so as to move the sliding bracket 158 from the extreme position shown in solid lines toward the extreme position shown in dotted lines in FIG. 15 or an intermediate position therebetween. The cylinder 150 will thus be precompressed relative to its position shown in full lines in FIG. 13*a* and be farther away from the center A of the person's ankles, thereby increasing the resistance to the downward movement of the carriage 120, as shown in FIG. 13*b*. Similarly, the distance between the fulcrum 178 and the bracket 196 joining the spring 190 and linking member 194 can be increased to adjust the movement of the backrest for a heavier person, as shown in FIG. 16 in solid lines and in FIG. 17, by causing the cable 198 to draw the bracket 196 away from the fulcrum 178, thereby increasing the resistance of the backrest to a downward and rearward movement. As can be seen, therefore, the position of the air cylinder 150 and of the spring 190 and bracket 196 can be adjusted simultaneously to provide equilibrium for heavier persons using the chair, merely by adjustment of the knob 222. Thereafter, the operation is the same as previously described.

Fulcrum 178 is on the H point axis, that is the hinge axis of the body sitting on the chair. Thus, the backrest 186 and the lever 176 pivot about the H point axis. When a person is sitting on the chair, the H point axis passes through the body hinge axis coincident with the hinge of the backrest. Therefore any shearing action of the backrest with the person's back is eliminated.

Figure 21:
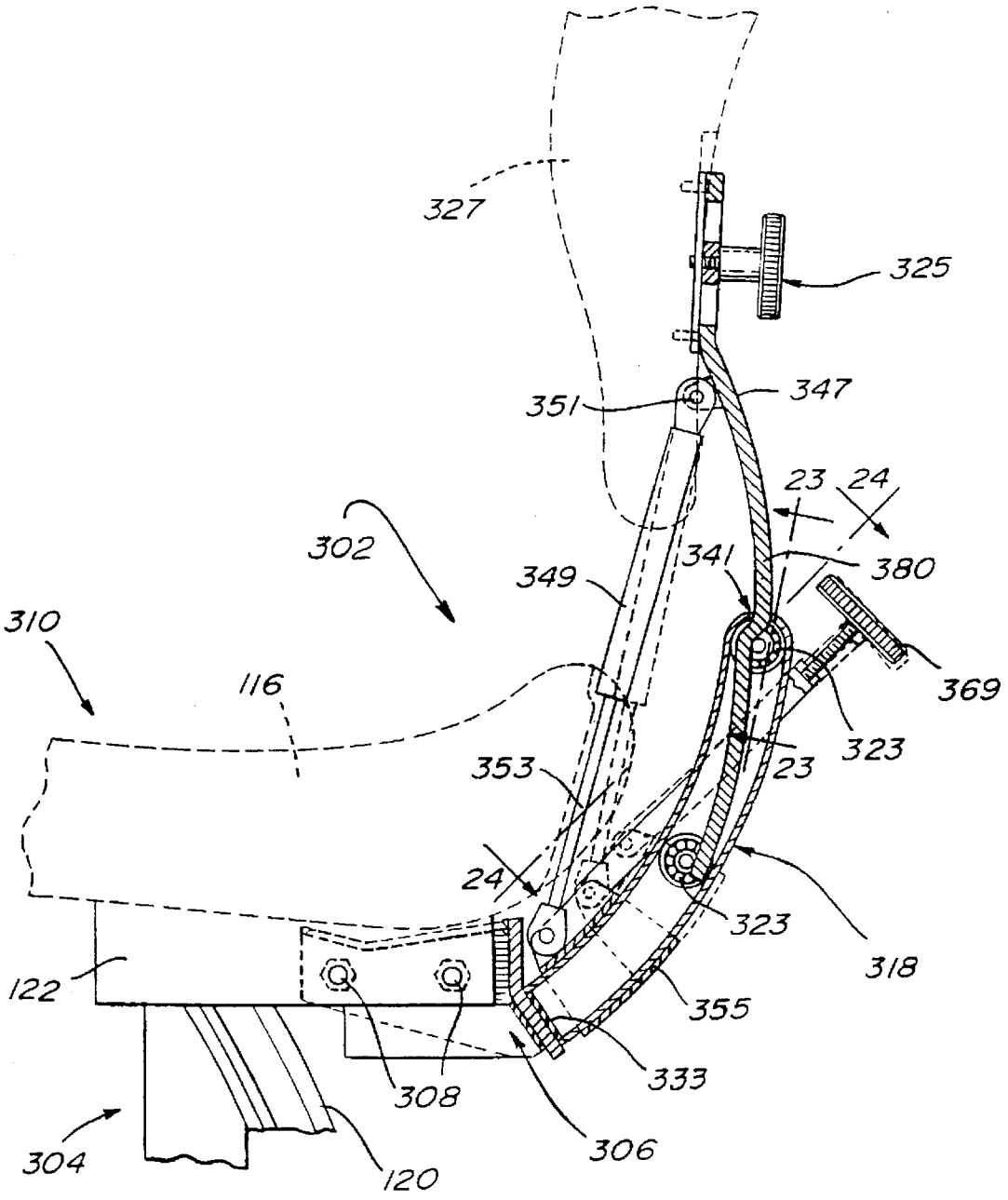
FIG. 21 is a side view of another embodiment of a backrest adapted to be mounted on a chair.
Figure 22:
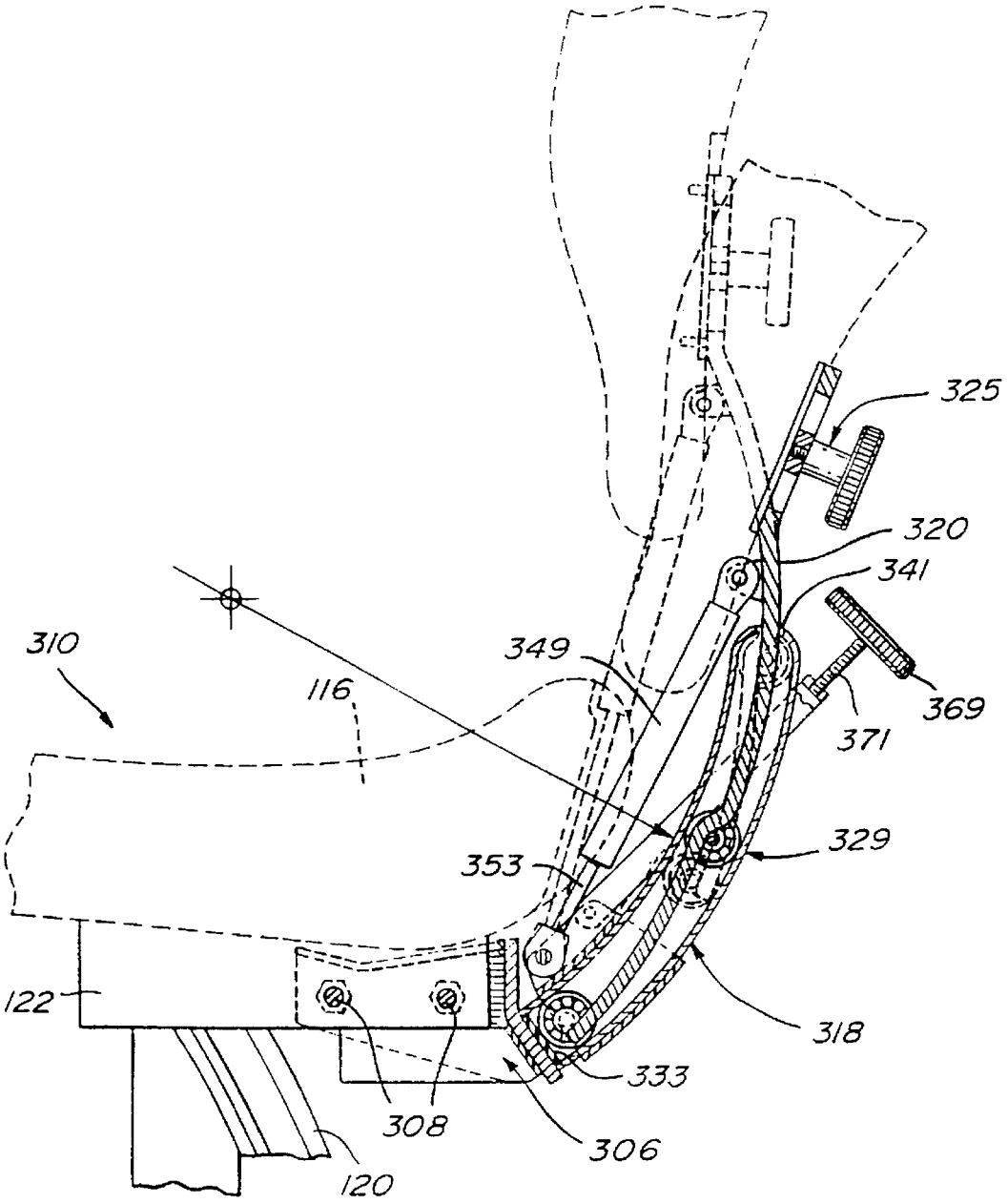
FIG. 22 side view of the backrest of FIG. 21 in a different operative position.

Referring now to FIGS. 21 to 25, it will be noted that the different parts are represented by reference numerals in the 300. A preferred embodiment of a backrest 302, adapted to be mounted on a chair 310 is illustrated. The chair 310 includes a support 304, and a seat 116 mounted thereon. The backrest 302 also includes a mounting member 306 adapted to be mounted on the support 304. In FIGS. 21 and 22, an embodiment Of the mounting member 306 is shown as including fasteners 308 securing the mounting member 306 of the backrest 302 to the seat pan 122.

The backrest 302 also includes a track member 318 fixedly mounted to the mounting member 306 and into which, the follower element 320 slides. The follower element 320 is welded or otherwise fixed to a low friction device such as ball bearings 323. The follower element 320 is fixedly mounted at its top end to a vertical adjustment device 325 for the dorsal support member 327. The vertical adjustment device 325 permits a lowering or a raising of same in relation with the height or desire of the user.

Figure 25:
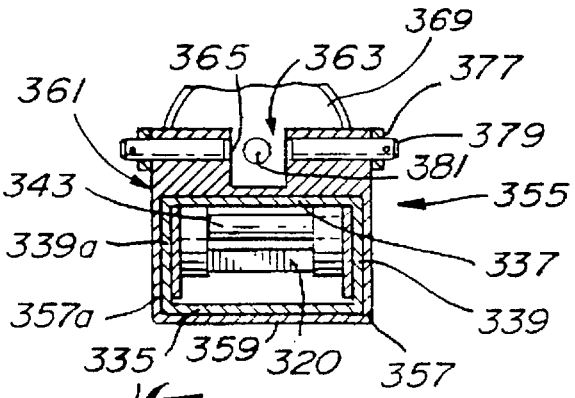
FIG. 25 is a cross-sectional view taken along lines 25—25 of FIG. 24.

The track member 318 includes a housing 329 comprising two end walls 331 and 333, a bottom wall 335, a top wall 337 and side walls 339 (339*a* representing the right-hand side wall), as best exemplified in FIGS. 21, 22 and 25. The end wall 331 of the housing 329 is provided with an opening 341 though which the follower element 320 can pass.

The track member 318 defines a segment of a circular arc having a radial center essentially coincident with the H point of the chair. The follower element 320 is provided with bearing ball members 323 mounted on a shaft 343, the shaft 343 being welded or otherwise fixed to the follower element 320. The side walls 339 of the housing 329 can also include a Teflon (a trademark of "E.I. dupont de Nemours") strip 345 which reduces the friction between the ball bearing member 323 and the adjacent side wall 339.

It is noted that the follower element follows a circular path which also has a radial center essentially coincident with the H point relative to the chair.

The top portion 347 of the follower element 320 rotatably mounts an air cylinder 349 through a bracket 351 or other mounting member. The air cylinder 349 also includes a piston 353 rotatably mounted on a carriage 355. The carriage 355 is provided with a side wall 357, a top wall 359 and a bottom wall 361, thereby encasing the housing 329. As best exemplified in FIGS. 24 and 25, the top wall 361 of the carriage 355 is provided with a channel shaped recess 363 with side walls 365, the side walls 365 of the recess 363 rotatably mounting the piston 353 by way of fasteners 367.

Figure 24:
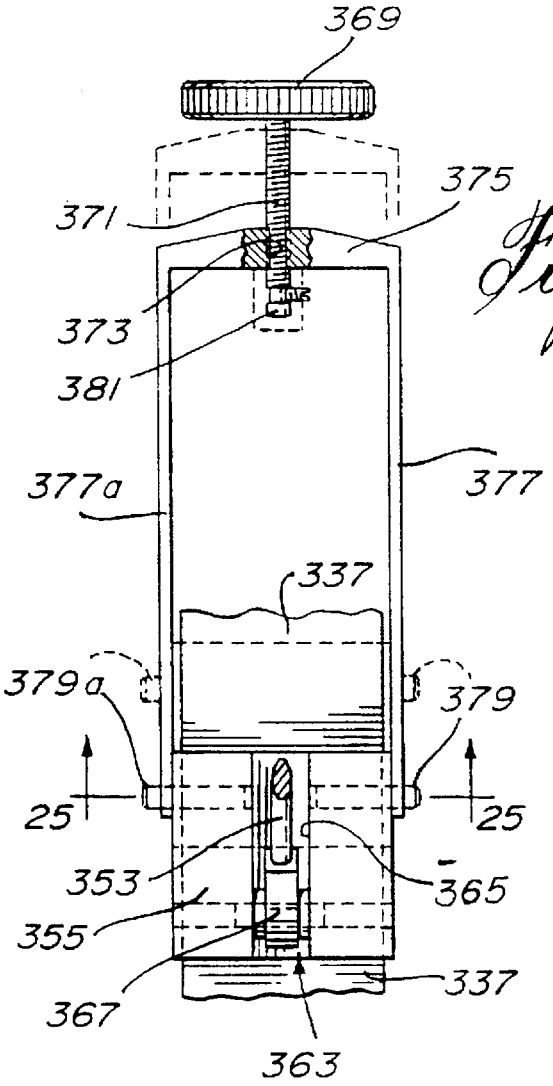
FIG. 24 is a cross-sectional view taken along lines 24—24 of FIG. 21.
Figure 23:
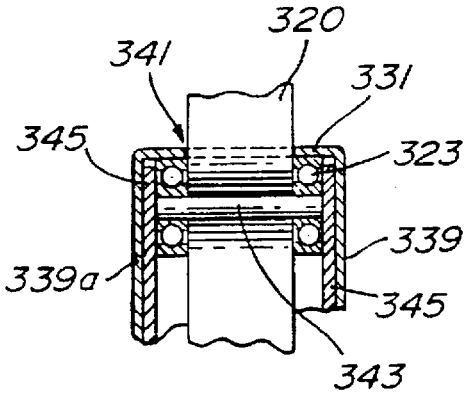
FIG. 23 is a cross-sectional view taken along lines 23—23 in FIG. 21.

As seen in FIGS. 21, 22 and 24, the carriage 355 is adapted to slide on the housing 329 by means of a knob 369 mounting a bolt 371 which is threaded and passes through a threaded bore 373 in a yoke member 375. The yoke member 375 also comprises legs 377 which are mounted on the top wall 361 of the carriage 355 by way of fasteners 379. The end of the threaded bolt 371, opposite the knob 369 is provided with a retaining member 381, such that a clockwise movement of the knob 369, translates into the yoke member moving in a rearward direction, thereby dragging along the carriage 355 between the position shown in full lines in FIGS. 21 and 24 and the position shown in dotted lines in the same FIGS. These two positions represent the extreme of the adjustment of the carriage 355 and therefore, of the air cylinder 349 (also shown in full and dotted lines in FIG. 21).

Thus, as a result of the rearward movement of the carriage 355 along the housing 329, by adjustment of the knob 369, the cylinder 349 will move towards the dotted line position in FIG. 21 and become pro-compressed by the action of the carriage 355 moving on the housing 329.

In operation, a person using the chair will assume a working position as shown in FIG. 11. In such a position, the person is upright or leaning forward over a work table. In such a case, the air cylinder 349 should be sufficient to maintain the backrest in its uppermost position, and thus, the follower element 320 will be in its uppermost position as shown in FIG. 21. The backrest is adjusted for a lighter person. The air cylinder 349 because of its resistance maintains the backrest erect. When the person leans back to a rest position, as shown in FIG. 22, the resistance of the air cylinder 349 is overcome by the action moment and the backrest 302 will move downwardly, the follower element 347 moving downwardly along the arcuate path traced by the track 318. As noted, the sliding movement of the follower element 320 in the track 318 is in a circular arc with the center H at the hip point relative to the chair. The downward movement of the backrest 302 results in a compression of the cylinder 349, as shown in FIG. 22. Once the person leans forward away from a rest position to an erect or work position, as shown in FIG. 12, the air cylinder 349 will extend to move the follower element 320, along with the dorsal support member 327 to its original upright position as shown in FIG. 21 in full lines and in dotted lines in FIG. 22.

As noted above, FIG. 22, and FIG. 21 in solid lines, Show the backrest 302 adapted for a lighter person. In the event that a heavier person is to use the chair, the knob 369 is rotated so as to move the carriage 355 towards the extreme position shown in dotted lines in FIG. 21 or an intermediate position therebetween. The cylinder 349 will thus be pro-compressed relative to its position shown in full lines in FIG. 21, thereby increasing the resistance to the downward movement of the follower element 320 along the track 318. Thus, the air cylinder 349 can be adjusted to provide equilibrium for heavier persons using the chair by merely adjusting the knob 369. Thereafter, the operation is the same as previously described.

Having described the preferred embodiments of the present invention, it will appear to those ordinarily skilled in the art that various modifications may be made to the disclosed embodiments, and that such modifications are intended to be within the scope of the present invention.

We claim:

1. A chair comprising a base, at least a fixed stem extending vertically from the base, a track member mounted to the top portion of the stem and a carriage slidable on a first track member, the first track member extending at an acute angle to the axis of the stem, and the carriage slides on the first track member within a vertical plane with the sliding movement of the carriage including a vertical component having a value greater than a respective value of a horizontal component of the sliding movement; a seat mounted on the carriage, resilient means extending between the carriage and the track member such that the seat is maintained in an uppermost equilibrium position with a person sitting erect on the chair in a work position but the carriage will slide downwardly on the track in response to a rearward shift in the weight by the person when the person moves from a work position to a rest position on the chair, and the seat and carriage will return to the uppermost equilibrium position as the person leans forward to the work position from the rest position.

2. A chair as defined in claim 1, wherein the track defines a circular arcuate segment with a radial center forward of the stem.

3. A chair as defined in claim 2, wherein the radial center of the circular arcuate segment is coincident with the knees of the person sitting on the chair.

4. A chair as defined in claim 2, wherein the radial center of the circular arcuate segment of the track member is coincident with the ankles of a person sitting on the chair.

5. A chair as defined in claim 1, wherein positive adjustment means are provided for adjusting the resilient means such that the uppermost equilibrium position of the carriage may be maintained in response to different body loads of persons utilizing the chair.

6. A chair as defined in claim 5, wherein the means to adjust the resilient member for different loads includes a ramp provided in the carriage at an acute angle to the horizontal and a bracket is provided in the carriage to slide against the ramp, wherein the bracket receives one end of a gas cylinder such that by moving the bracket against the ramp in a rearward direction, the gas cylinder will be compressed thereby increasing the resistance of the gas cylinder for providing resistance to a greater load.

7. A chair as defined in claim 1, wherein the resilient means is a gas cylinder and piston with the piston engaged in one of the track member and carriage and the cylinder is engaged in the other of the track member and carriage.

8. A chair as defined in claim 7, wherein in addition to the gas cylinder and piston there is provided a tension spring anchored one to the track member and the other into the carriage to supplement the gas cylinder.

9. A chair as defined in claim 8, wherein the tension spring is a coal spring having at one end means to anchor the coil spring to the carriage member and a lost motion slot at the other end thereof adapted to engage a mounting pin means on the carriage, and the mounting pin means on the carriage engages the end of the lost motion slot and therefore the coil spring only when the carriage has been lowered past a predetermined position on the track against the gas cylinder.

10. A chair as defined in claim 1, wherein the resilient means is a gas cylinder and piston with the gas cylinder fixedly mounted on the seat and the piston is engaged in the other of the track member and a carriage.

11. A chair as defined in claim 10, wherein the resilient member can be adjusted for different loads through a seat tension adjustment means which includes a track at an acute angle to the horizontal and a bracket to slide on the track, wherein the bracket receives one end of a gas cylinder such that by moving the bracket against the track in a rearward direction, the gas cylinder will be compressed thereby increasing the resistance of the gas cylinder for providing resistance to a greater load.

12. A chair as defined in claim 11, wherein the movement of the bracket is operated by bowden cables fixedly mounted at one end on either sides of the bracket and at their other end to a tension control device, such that the bowden cables have opposite actions on the movement of the bracket.

13. A chair as defined in claim 12, wherein the chair has a predetermined H point which is located forwardly of a backrest and upwardly of the seat, and wherein said backrest can tilt rearwardly and downwardly in response to a rearward shift in the weight of a person sitting on the chair, the tilt of the backrest following a rotational movement about an axis essentially coincident with the H point relative to the chair, the chair including support means, the backrest having mounting means, the mounting means comprising a crank lever, the crank lever comprising a first leg fixedly mounted to the backrest, a fulcrum on the support means coincident with the axis of rotation, the crank lever being mounted for rotation at the fulcrum, the crank lever including a second leg extending away from the fulcrum opposite the first leg, a backrest resilient means having a first end anchored at a fixed point on the support means and a second end anchored to a fixed point on the second leg, adjustment means provided for remotely adjusting the tension of said backrest resilient means, whereby the resistance against tilting of the backrest can be increased or decreased as a direct relation to the weight of the person sitting on the chair and leaning against the backrest; the adjustment means including cable means operably connected to a point on the resilient means between the first and second end of the resilient means to effectively increase the length of the resilient means and thereby increase the degree of tension of the resilient means or release said degree of tension.

14. A chair as defined in claim 13, wherein the backrest resilient means comprises:

a) a tension spring pivotably anchored at a one end to the first point on the support means;

b) a link member having first and second ends, wherein the first end is attached to the other end of the spring by a connecting means defining a tension adjustment point, and the second end of the link member is pivotably mounted to said fixed point on the second leg, said adjustment means for remotely adjusting the tension of said backrest resilient means includes backrest cable means operably connected at said one end to the tension adjustment point, the other end of the backrest cable means being operably connected to a cable winding means whereby activation of said cable winding means translates into a variation in the tension of the tension spring such that resistance to tilting of the backrest is increased as the tension in the tension spring is increased.

15. A chair as defined in claim 14, wherein the backrest cable means is another bowden cable.

16. A chair as defined in claim 15, wherein the tension control device comprises a first spool mounted for rotation on the chair in order to wind the other bowden cable and a second spool mounted coaxially to said first spool in order to wind the bowden cables for moving the bracket; locking means selectively restraining the first and second spools from rotation and a knob controlling the rotation of said spools such that turning of the knob winds and unwinds said other bowden cable and said bowden cables for moving the bracket, thus varying the distance between the tension control point and the fulcrum on the one hand and the movement of the bracket in the track, on the other hand, wherein the tension control device provides a means of adjusting both the seat and backrest simultaneously according to the weight of the person sitting on the chair.

17. A chair as defined in claim 12 the chair having a support, the chair further comprising a backrest, the backrest comprising mounting means adapted to be fixedly secured to the support, a second track fixedly connected to the mounting means, the second track defining a circular arcuate segment having a radial center essentially coincident with the H point relative to the chair, a follower element having a first and a second end the first end being mounted to a dorsal support member and the second end being slidable on the second track, low friction sliding means provided between the second end and the second track, whereby the backrest will tilt rearwardly and downwardly in response to a rearward shift in the weight of a person leaning against the dorsal support member; the backrest further comprising a second resilient means extending between the follower element and the second track such that the dorsal support member is maintained in an uppermost equilibrium position with a person sitting erect on the chair in a work position and whereby the follower element will slide downwardly along the second track in response to a rearward shift in the weight by the person when the person moves from a work position to a rest position on the chair against the resistance provided by the resilient means, and the dorsal support member and follower element will return to the uppermost equilibrium position as the person leans forward to the work position from the rest position.

18. A chair as defined in claim 1, wherein the chair has a predetermined H point which is located forwardly of a backrest and upwardly of the seat, and wherein said backrest is movably mounted to said chair and, which can tilt rearwardly and downwardly in response to a rearward shift in the weight of the person sitting on the chair, the tilt of the backrest following a circular arcuate path having a radial center which is essentially coincident with the H point relative to the chair.

19. A chair as defined in claim 1, wherein the chair has a predetermined H point, which is located forwardly of a backrest and upwardly of the seat, and wherein said backrest can tilt rearwardly and downwardly in response to a rearward shift in the weight of a person sitting on the chair, the tilt of the backrest following a rotational movement about an axis essentially coincident with the H point relative to the chair, the chair including support means, the backrest having mounting means, the mounting means comprising a crank lever, the crank lever comprising a first leg fixedly mounted to the backrest, a fulcrum on the support means coincident with the axis of rotation, the crank lever being mounted for rotation at the fulcrum, the crank lever including a second leg extending away from the fulcrum opposite the first leg, a backrest resilient means having a first end anchored at a fixed point on the support means and a second end anchored to a fixed point on the second leg; adjustment means provided for remotely adjusting the tension of said backrest resilient means, whereby the resistance against tilting of the backrest can be increased or decreased as a direct relation to the weight of the person sitting on the chair and leaning against the backrest; the adjustment means including cable means operably connected to a point on the resilient means between the first and second end of the resilient means to effectively increase the length of the resilient means and thereby increase the degree of tension of the resilient means or release said degree of tension.

20. A chair as defined in claim 1, the chair having a support, the chair further comprising a backrest, the chair having a predetermined H point which is located forwardly of the backrest and upwardly of the seat, the backrest comprising mounting means adapted to be fixedly secured to the support, a second track fixedly connected to the mounting means, the second track defining a circular arcuate segment having a radial center essentially coincident with the H point relative to the chair, a follower element having a first and a second end, the first end being mounted to a dorsal support member and the second end being slidable on the second track, low friction sliding means provided between the second end and the second track, whereby the backrest will tilt rearwardly and downwardly in response to a rearward shift in the weight of a person leaning against the dorsal support member; the backrest further comprising a second resilient means extending between the follower element and the second track such that the dorsal support member is maintained in an uppermost equilibrium position with a person sitting erect on the chair in a work position and whereby the follower element will slide downwardly along the second track in response to a rearward shift in the weight by the person when the person moves from a work position to a rest position on the chair against the resistance provided by the resilient means, and the dorsal support member and follower element will return to the uppermost equilibrium position as the person leans forward to the work position from the rest position.

21. A backrest on a chair whereby the backrest can tilt rearwardly and downwardly in response to a rearward shift in the weight of a person sitting on the chair, the chair having a predetermined H point, which is located forwardly of the backrest and upwardly of a seat the tilt of the backrest following a rotational movement about an axis essentially coincident with the H point relative to the chair, the chair including support means, the backrest having mounting means, the mounting means comprising a crank lever, the crank lever comprising a first leg fixedly mounted to the backrest, a fulcrum on the support means coincident with the axis of rotation, the crank lever being mounted for rotation at the fulcrum, the crank lever including a second leg extending away from the fulcrum opposite the first leg, a backrest resilient means having a first end anchored at a fixed point on the support means and a second end anchored to a fixed point on the second leg, adjustment means provided for remotely adjusting the tension of said backrest resilient means, whereby the resistance against tilting of the backrest can be increased or decreased as a direct relation to the weight of the person sitting on the chair and leaning against the backrest; the adjustment means including cable means operably connected to a point on the resilient means between the first and second end of the resilient means to effectively increase the length of the resilient means and thereby increase the degree of tension of the resilient means or release said degree of tension.

22. A backrest as defined in claim 21, wherein the adjustment means is a positive adjustment means, such that the erect position of the backrest may be maintained in response to different body loads of persons utilizing the chair.

23. A backrest as defined in claim 21, wherein the backrest resilient means comprises:

a) a tension spring pivotably anchored at a one end to the first point on the support means;

b) a link member having first and second ends, wherein the first end is attached to the other end of the spring by a connecting means defining a tension adjustment point, and the second end of the link member is pivotably mounted to said fixed point on the second leg, said adjustment means for remotely adjusting the tension of said backrest resilient means includes cable means operably connected at said one end to the tension adjustment point, the other end of the cable means being operably connected to a cable winding means whereby activation of said cable winding means translates into a variation in the tension of the tension spring such that resistance to tilting of the backrest is increased as the tension in the tension spring is increased.

24. A backrest as defined in claim 23, wherein the tension of said resilient means is further varied by increasing or decreasing the distance between the fulcrum and the tension adjustment point by adjusting said cable means.

25. A backrest as defined in claim 24, wherein the spring is a coil spring.

26. A backrest as defined in claim 25, wherein the winding means comprises a spool, mounted for rotation on the chair in order to wind the cable a locking means selectively restraining the spool from rotation and a knob controlling the rotation of the spool such that turning of the knob winds and unwinds the cable means.

27. A backrest as defined in claim 26, wherein the cable means is a bowden cable.

28. A backrest on a chair, the chair having a seat and a support therefor, the backrest comprising mounting means adapted to be fixedly secured to the support, the chair having a predetermined H point which is located forwardly of the backrest and upwardly of the seat, a track fixedly connected to the mounting means, the track defining a circular arcuate segment having a radial center essentially coincident with the H point relative to the chair, a follower element having a first and a second end, the first end being mounted to a back support member and the second end being slidable on the track, low friction sliding means provided between the second end and the track, the backrest further comprising resilient means extending between the follower element and the track such that the back support member is maintained in an uppermost equilibrium position with a person sitting erect on the chair in a work position and whereby the follower element will slide downwardly along the track in response to a rearward shift in the weight by the person when the person moves from a work position to a rest position on the chair against the resistance provided by the resilient means, and the back support member and follower element will return to the uppermost equilibrium position as the person leans forward to the work position from the rest position.

29. A backrest as defined in claim 28, wherein positive adjustment means are provided for adjusting the resilient means such that the uppermost equilibrium position of the follower element may be maintained in response to different body loads of users of the chair.

30. A backrest as defined in claim 29, wherein the means to adjust the resilient member for different body loads includes a carriage slidable on a second track, the second track defining a circular arcuate segment which is coaxial to that of said track, wherein the carriage receives one end of a gas cylinder such that by moving the carriage in a rearward direction, the gas cylinder will be compressed thereby increasing the resistance of the gas cylinder for providing resistance to a greater load.

31. A backrest as defined in claim 30, wherein the movement of the carriage is operated by a yoke member having two arms, the two arms being connected to the carriage, the yoke member having a threaded bore through which a threaded shaft is rotatably engaged, the threaded shaft being mounted at one end to a handle means and at another end to a retaining member, such that a clockwise rotation of the handle means translates into a clockwise rotation of the threaded shaft and a rearward direction of the yoke member thereby translating into a rearward direction of the gas cylinder and a compression thereof.

32. A backrest as defined in claim 31, wherein the low friction device comprises at least one shaft fixed to the follower element and ball bearing wheels mounted at each end of the at least one shaft, such that the ball bearing wheels will roll along the track.

33. A backrest as defined in claim 31, wherein the chair comprises a base, at least a fixed stem extending vertically from the base, a rail member mounted to the top portion of the stem and a carriage member slidable on the rail member, the rail member extending at an acute angle to the axis of the stem, and the carriage member slides on the rail member within a vertical plane with the sliding movement of the carriage member including a vertical component having a value greater than a respective value of a horizontal component of the sliding movement; a seat mounted on the rail member, resilient means extending between the carriage member and the rail member such that the seat is maintained in an uppermost equilibrium position with a person sitting erect on the chair in a work position but the carriage member will slide downwardly on the rail member in response to a rearward shift in the weight by the person when the person moves from a work position to a rest position on the chair, and the seat and rail member will return to the uppermost equilibrium position as the person leans forward to the work position from the rest position.

34. A backrest as defined in claim 28, wherein the resilient means is a gas cylinder and piston with the piston connected to a carriage slidable on a second track and the cylinder is mounted in the follower element, the second track defining a circular arcuate segment which is coaxial to that of said track.

35. A backrest as defined in claim 34, wherein said track comprises a housing having inner and outer surfaces, bottom, top and side walls; the follower element sliding along the inner surface of the housing; the inside surface of the housing defining said track, the carriage encasing the housing and adapted to slide on the outer surface thereof, whereby the outside surface of the housing defines the second track.

36. A backrest as defined in claim 35, wherein the inner surfaces of the side walls are coated with a low friction substance.

37. A backrest as defined in claim 28, wherein the low friction device comprises at least one shaft fixed to the follower element and ball bearing wheels mounted at each end of at least one shaft, such that the ball bearing wheels will roll along the track.

* * * * *